US012146296B2

(12) United States Patent
Nagao et al.

(10) Patent No.: US 12,146,296 B2
(45) Date of Patent: Nov. 19, 2024

(54) WORKING MACHINE

(71) Applicant: KUBOTA CORPORATION, Osaka (JP)

(72) Inventors: Kohei Nagao, Osaka (JP); Yuji Fukuda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 482 days.

(21) Appl. No.: 17/550,585

(22) Filed: Dec. 14, 2021

(65) Prior Publication Data

US 2022/0259826 A1 Aug. 18, 2022

(30) Foreign Application Priority Data

Feb. 17, 2021 (JP) ..... 2021-23481

(51) Int. Cl.
*E02F 9/22* (2006.01)

(52) U.S. Cl.
CPC ..... *E02F 9/2253* (2013.01); *E02F 9/2296* (2013.01)

(58) Field of Classification Search
CPC ..... E02F 9/2253; E02F 9/2296
See application file for complete search history.

(56) References Cited

U.S. PATENT DOCUMENTS

2004/0188168 A1* 9/2004 Aumann ..... B60W 10/30 180/336
2007/0119163 A1* 5/2007 Tatsuno ..... F16H 61/4148 60/493
2015/0066317 A1* 3/2015 Ishibashi ..... F16H 61/4008 701/51
2015/0275483 A1* 10/2015 Tsukamoto ..... F16P 3/141 701/50
2019/0345691 A1* 11/2019 Haberman ..... E02F 9/2296
2021/0047802 A1* 2/2021 Fukuda ..... E02F 9/2289
2021/0363730 A1* 11/2021 Fukuda ..... E02F 9/2235

FOREIGN PATENT DOCUMENTS

JP 2008-82130 A 4/2008

OTHER PUBLICATIONS

2016 Tesla Model S Manual (Year: 2016).*

* cited by examiner

*Primary Examiner* — Mahmoud S Ismail
*Assistant Examiner* — Gabriel Anfinrud
(74) *Attorney, Agent, or Firm* — Greenblum & Bernstein, P.L.C.

(57) ABSTRACT

A working machine includes a traveling motor that is shifted between a first speed and a second speed faster than the first speed, a traveling pump that supplies hydraulic fluid to the traveling motor, a traveling operation member operable to operate the traveling pump, and a controller including an automatic speed reduction unit that performs automatic speed reduction in which the traveling motor having been shifted to the second speed is automatically shifted from the second speed to the first speed based on the operation amount of the traveling operation member. The controller includes an automatic speed reduction restraining unit configured or programmed to restrain the automatic speed reduction from being performed when the traveling operation member is operated to steeply change the operation amount from a first operation amount to a second operation amount.

10 Claims, 14 Drawing Sheets

WORKING MACHINE

CROSS REFERENCE TO RELATED APPLICATIONS

This application claims the benefit of priority to Japanese Patent Application No. 2021-23481 filed on Feb. 17, 2021. The entire contents of this application are hereby incorporated herein by reference.

BACKGROUND OF THE INVENTION

1. Field of the Invention

The present invention relates to a working machine.

2. Description of the Related Art

A working machine disclosed in Japanese Unexamined Patent Publication No. 2008-82130 (Patent document 1) is known.

The working machine disclosed in Patent document 1 includes a traveling motor shiftable between a first speed and a second speed that is higher than the first speed, and is configured to perform automatic speed reduction to shift the traveling motor from the second speed to the first speed when a load exceeding a predetermined level is applied to the traveling motor while the traveling motor is being actuated at the second speed.

SUMMARY OF THE INVENTION

Considering a case of a configuration where a motor rotation speed threshold is set corresponding to an operation amount of a traveling operation member for operating a traveling motor, information on the operation amount of the traveling operation member and the rotation speed of the traveling motor can be sensed, and then automatic speed reduction is executed when the rotation speed of the traveling motor falls to be lower than the motor rotation speed threshold, the automatic speed reduction may be executed unintentionally in a case where the operation amount of the traveling operation member is steeply changed from a first operation amount to a second operation amount.

In view of the above-mentioned problems, it is intended to provide a working machine capable of restraining accidental automatic speed reduction in a case where an operation amount of a traveling operation member is steeply changed from a first operation amount to a second operation amount.

In an aspect, a working machine includes a vehicle body, a traveling device supporting the vehicle body so as to allow the vehicle body to travel, a traveling motor configured to output power to the traveling device and be shifted between a first speed and a second speed faster than the first speed, a traveling pump configured to supply hydraulic fluid to the traveling motor, a rotation speed detector configured to detect a motor rotation speed that is a rotation speed of the traveling motor, a traveling operation member operable to operate the traveling pump, an operation detector configured to detect an operation amount of the traveling operation member, and a controller including an automatic speed reduction unit configured or programmed to perform automatic speed reduction in which the traveling motor having been shifted to the second speed is automatically shifted from the second speed to the first speed based on the operation amount of the traveling operation member. The controller includes an automatic speed reduction restraining unit configured or programmed to restrain the automatic speed reduction from being performed when the traveling operation member is operated to steeply change the operation amount from a first operation amount to a second operation amount.

Also, the automatic speed reduction restraining unit includes an operation amount change calculation section configured or programmed to calculate, when the traveling operation member is operated to change the operation amount from the first operation amount to the second operation amount, a virtual change rate of the operation amount that defines a time delay from an actual change rate of the operation amount from the first operation amount to the second operation amount, the time delay being increased according to increase of the operation amount, and a rotation speed threshold calculation section configured or programmed to calculate a virtual motor rotation speed threshold corresponding to the virtual change rate of the operation amount calculated by the operation amount change calculation section. The automatic speed reduction unit is configured or programmed to perform the automatic speed reduction when the traveling motor is in the second speed and the motor rotation speed detected by the rotation speed detector becomes less than the virtual motor rotation speed threshold.

Also, the automatic speed reduction unit is configured or programmed to judge whether the motor rotation speed is less than the virtual motor rotation speed threshold or not after the traveling operation member has been operated to change the operation amount from the first operation amount for a predetermined period.

Also, the operation amount change calculation section is configured or programmed to calculate the virtual change rate of the operation amount after the traveling operation member has been operated to change the operation amount from the first operation amount for a predetermined period.

Also, the automatic speed reduction restraining unit is configured or programmed to keep, when the traveling operation member is operated to change the operation amount from the first operation amount to the second operation member, the automatic speed reduction unit from performing the automatic speed reduction until the traveling operation member has been operated to change the operation amount from the first operation amount for a predetermined period.

Also, the automatic speed reduction is kept from being performed for a period of time that is taken to increase the motor rotation speed while the traveling operation member is operated to have the second operation amount until the motor rotation speed reaches the motor rotation speed threshold for the judgment by the automatic speed reduction unit regarding whether to perform the automatic speed reduction.

Also, the time since the traveling operation member is operated to change the operation amount from the first operation amount until the automatic speed reduction unit judges whether the motor rotation speed is less than the virtual motor rotation speed threshold or not is able to be changed according to variation in the motor rotation speed and the second operation amount.

Also, the working machine includes a prime mover to drive the traveling pump. The time since the traveling operation member is operated to change the operation amount from the first operation amount until the automatic speed reduction unit judges whether the motor rotation speed is less than the virtual motor rotation speed threshold or not is able to be changed according to a rotation speed of the prime mover.

Also, the controller is configured or programmed to determine that the traveling operation member is in neutral when the operation amount of the traveling operation member is less than a neutral judgment amount defined as the operation amount changed from the first operation amount by a predetermined amount, and to keep the automatic speed reduction from being performed when the traveling operation member is in neutral.

Also, the working machine includes a prime mover to drive the traveling pump. The motor rotation speed threshold is able to be changed according to a rotation speed of the prime mover.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1A:
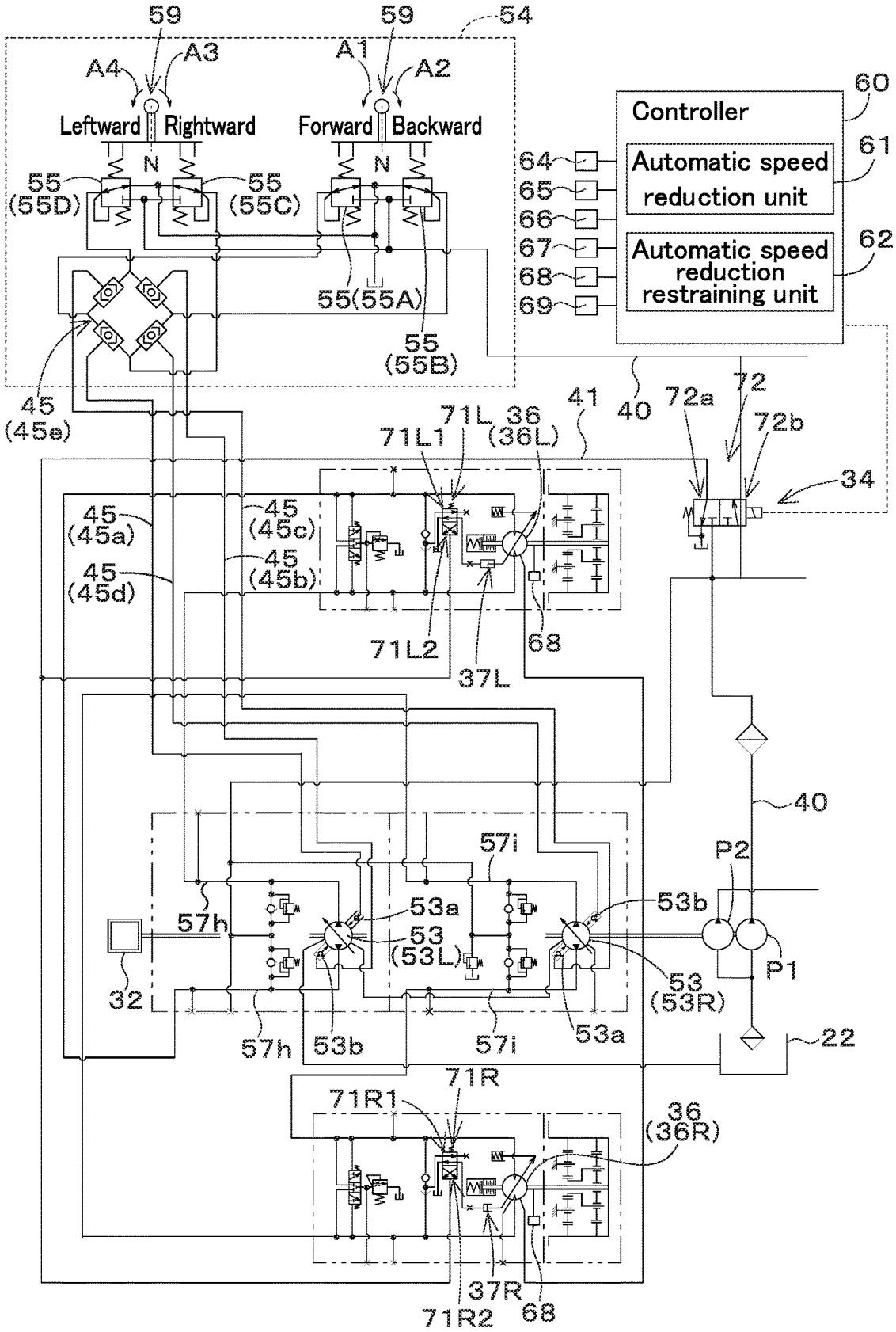
FIG. 1A is a view showing a hydraulic system (hydraulic circuit) for a working machine.

The preferred embodiments will now be described with reference to the accompanying drawings, wherein like reference numerals designate corresponding or identical elements throughout the various drawings. The drawings are to be viewed in an orientation in which the reference numerals are viewed correctly.

A preferred embodiment of the hydraulic system for a working machine 1 and the working machine 1 including the hydraulic system will be described below with reference to drawings as appropriate.

Figure 12:
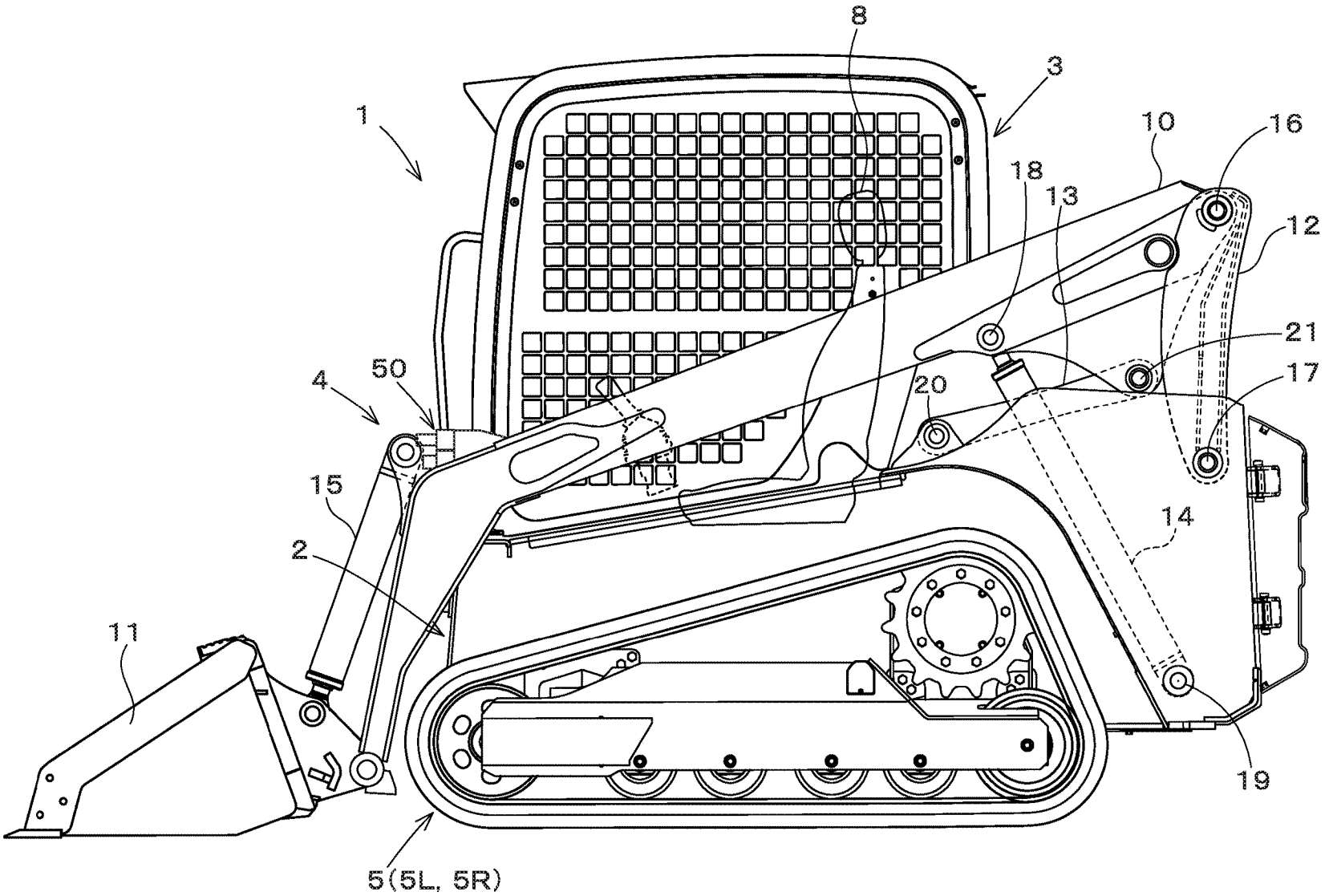
FIG. 12 is a side view showing a track loader that is an example of the working machine.

FIG. 12 shows a side view of the working machine 1 according to the present invention. In FIG. 12, a compact track loader is shown as an example of the working machine 1. However, the working machine 1 according to the embodiment is not limited to the compact track loader, and may be another type of loader such as a skid steer loader, for example. The working machine 1 may also be a working machine other than the loader.

As shown in FIG. 12, the working machine 1 includes a machine body 2, a cabin 3, a working device 4, and a traveling device 5. In the embodiment, a forward direction (left side in FIG. 12) of a driver sitting on a driver's seat 8 of the working machine 1 is described as the front, a rearward direction (right side in FIG. 12) of the driver is described as the rear, a leftward direction (front surface side of FIG. 12) of the driver is described as the left, and a rightward direction (back surface side of FIG. 12) of the driver is described as the right. In addition, a horizontal direction, which is orthogonal to a fore-and-aft direction, is described as a machine width direction. A direction from a center portion of the machine body 2 to a right portion or left portion thereof is described as a machine body outward direction. In other words, the machine body outward direction is a direction separating from the machine body 2 in the machine width direction. A direction opposite to the machine body outward direction is described as a machine body inward direction. In other words, the machine body inward direction is a machine body width direction approaching the machine body 2.

The cabin 3 is mounted on the machine body 2. The driver's seat 8 is disposed in the cabin 3. The working device 4 is attached to the machine body 2. The traveling device 5 includes a pair of traveling devices 5L and 5R, which are provided on respective outer sides of the machine body 2. A prime mover 32 is mounted on a rear inside portion of the machine body 2.

The working device 4 includes booms 10, a working tool 11, lift links 12, control links 13, boom cylinders 14, and bucket cylinders (working tool cylinders) 15.

The booms 10 are disposed, swingably up and down, on right and left sides of the cabin 3, respectively. The working tool 11 is, for example, a bucket, and the bucket 11 is provided, swingably up and down, to tip portions (front end portions) of the booms 10. The lift links 12 and the control links 13 support base portions (rear portions) of the booms 10 so as to allow the booms 10 to swing up and down. The boom cylinders 14 are extended and contracted to raise and lower the booms 10. The bucket cylinders 15 are extended and contracted to swing the bucket 11.

Front portions of the left and right booms 10 are connected to each other by a deformed connecting pipe. The base portions (rear portions) of the booms 10 are connected to each other by a circular connecting pipe.

A pair of lift links 12, a pair of control links 13 and a pair of boom cylinders 14 are disposed on the left and right sides of the machine body 2, corresponding to the booms 10 on the left and right sides of the machine body 2.

The lift links 12 are extended vertically from rear portions of the base portions of the booms 10. Upper portions (one end sides) of the lift links 12 are pivotally supported on relatively rear portions of the base portions of the booms 10 rotatably around lateral axes defined by pivot shafts 16 (first pivot shafts). In addition, lower portions (other end sides) of the lift links 12 are pivotally supported on a relatively rear portion of the machine body 2 rotatably around the lateral axes defined by pivot shafts 17 (second pivot shafts). The second pivot shafts 17 are disposed below the first pivot shafts 16.

Upper portions of the boom cylinders 14 are pivotally supported rotatably around the lateral axes defined by pivot shafts 18 (third pivot shafts) disposed on the base portions of the booms 10. and at front portions of the base portions. Lower portions of the boom cylinders 14 are supported rotatably around the lateral axis by pivot shafts 19 (fourth pivot shafts). The fourth pivot shafts 19 are disposed, below the third pivot shafts 18, near a lower portion of the rear portion of the machine body 2.

The control links 13 are disposed forward of the lift links 12. One ends of the control links 13 are pivotally supported rotatably around lateral axes by respective pivot shafts 20 (fifth pivot shafts). The fifth pivot shafts 20 are disposed, in the machine body 2, at positions corresponding to the lift links 12 in front of the lift links 12. The other ends of the control links 13 are pivoted rotatably around lateral axes defined by pivot shafts 21 (sixth pivot shafts). The sixth pivot shafts 21 are disposed, in the boom 10, in front of and above the second pivot shafts 17.

When the boom cylinders 14 are extended and contracted, the booms 10 are swung up and down around the first pivot shafts 16, while the base portions of the booms 10 are supported by the lift links 12 and the control links 13. The control links 13 are swung up and down around the fifth pivot shafts 20 in accordance with the vertical swinging of the booms 10. The lift links 12 are swung back and forth around the second pivot shafts 17 in accordance with the vertical swinging of the control links 13.

An alternative working tool can be attached to the front portions of the booms 10 instead of the bucket 11. For example, an attachment (auxiliary attachment) such as a hydraulic crusher, a hydraulic breaker, an angle broom, an earth auger, a pallet fork, a sweeper, a mower, a snow blower, or the like may serve as the alternative working tool.

A connecting member 50 is disposed at the front portion of the left boom 10. The connecting member 50 is a device that connects a hydraulic unit provided on the auxiliary attachment to a first pipe member, such as a pipe disposed on the boom 10. Specifically, the first pipe member can be connected to one end of the connecting member 50, and a second pipe member connected to the hydraulic unit of the auxiliary attachment can be connected to the other end of the connecting member 50. In this manner, hydraulic fluid flowing in the first pipe member is supplied to the hydraulic unit through the second pipe member.

The bucket cylinders 15 are located near the front portions of the respective booms 10. When the bucket cylinders 15 is extended and contracted, the bucket 11 is swung.

Of the pair of traveling devices 5L and 5R, the traveling device 5L is disposed on the left portion of the machine body 2, and the traveling device 5R is disposed on the right portion of the machine body 2. In the embodiment, crawler traveling devices (including semi-crawler traveling devices) are adopted as the pair of traveling devices 5L and 5R. Wheel traveling devices having front and rear wheels may also be adopted. For convenience of explanation, the traveling device 5L may be referred to as the left traveling device 5L, and the traveling device 5R may be referred to as the right traveling device 5R.

The prime mover 32 is an internal combustion engine such as a diesel engine or a gasoline engine, an electric motor, or the like. In the embodiment, the prime mover 32 is a diesel engine; however the prime mover 32 is not limited thereto.

Next, the hydraulic system for the working machine 1 will be described.

As shown in FIG. 1A, the hydraulic system for the working machine 1 includes a first hydraulic pump P1 and a second hydraulic pump P2. The first hydraulic pump P1 is a pump configured to be driven by a power of the prime mover 32 and is constituted of a constant displacement gear pump. The first hydraulic pump P1 is capable of delivering the hydraulic fluid stored in a tank 22. Specifically, the first hydraulic pump P1 delivers the hydraulic fluid that is mainly used for control. For convenience of explanation, the tank 22 storing the hydraulic fluid may be referred to as a hydraulic fluid tank. Of the hydraulic fluid delivered from the first hydraulic pump P1, the hydraulic fluid used for control may be referred to as a pilot fluid, and a pressure of the pilot fluid may be referred to as a pilot pressure.

The second hydraulic pump P2 is a pump configured to be driven by a power of the prime mover 32, and is constituted of a constant displacement gear pump. The second hydraulic pump P2 is capable of delivering the hydraulic fluid stored in the tank 22 and, for example, supplies the hydraulic fluid to fluid passages of a working system. For example, the second hydraulic pump P2 supplies the hydraulic fluid to the boom cylinders 14 for operating the booms 10, the bucket cylinders 15 for operating the bucket 11, and a control valve (flow-rate control valve) configured to control an auxiliary hydraulic actuator for operating the auxiliary hydraulic actuator.

In addition, the hydraulic system for the working machine 1 includes traveling motors 36 configured to output a power to the traveling devices 5, and traveling pumps 53 configured to supply the hydraulic fluid to the traveling motors 36. Each of the traveling motors 36 is shiftable between a first speed stage and a second speed stage that is faster than the first speed stage. The traveling motors 36 include a pair of traveling motors 36L and 36R. The pair of traveling motors 36L and 36R are motors configured to output the power to the pair of traveling devices 5L and 5R. Specifically, of the pair of traveling motors 36L and 36R, the traveling motor 36L outputs a rotation power to the traveling device (left traveling device) 5L, and the traveling motor 36R outputs a rotation power to the traveling device (right traveling device) 5R.

The traveling pumps 53 include a pair of traveling pumps 53L and 53R. The pair of traveling pumps 53L and 53R are pumps configured to be driven by the power of the prime mover 32 and are variable displacement axial pumps with swash plates, for example. The pair of traveling pumps 53L and 53R, when being driven, supply the hydraulic fluid to each of the pair of traveling motors 36L and 36R. Specifically, of the pair of traveling pumps 53L and 53R, the traveling pump 53L supplies the hydraulic fluid to the traveling motor 36L, and the traveling pump 53R supplies the hydraulic fluid to the traveling motor 36R.

For convenience of explanation, the traveling pump 53L may be referred to as the left traveling pump 53L, the traveling pump 53R may be referred to as the right traveling pump 53R, the traveling motor 36L may be referred to as the left traveling motor 36L, and the traveling motor 36R may be referred to as the right traveling motor 36R.

Each of the left traveling pump 53L and the right traveling pump 53R has a forward-traveling pressure receiving portion 53*a* and a backward-traveling pressure receiving portion 53*b* to which the pressures (pilot pressures) of the hydraulic fluid (pilot fluid) from the first hydraulic pump P1 are applied. Angles of the swash plates are changed by the pilot pressures applied to the pressure receiving portions 53*a* and 53*b*. By changing the angles of the swash plates, outputs (delivery rate of hydraulic fluid) and directions of hydraulic fluid from the left and right traveling pumps 53L and 53R can be changed.

The left traveling pump 53L and the left traveling motor 36L are connected by a connecting fluid passage 57*h*, and the hydraulic fluid delivered from the left traveling pump 53L is supplied to the left traveling motor 36L. The right traveling pump 53R and the right traveling motor 36R are connected by a connecting fluid passage 57*i*, and the hydraulic fluid delivered from the right traveling pump 53R is supplied to the right traveling motor 36R.

The left traveling motor 36L is configured to be rotated by the hydraulic fluid delivered from the left traveling pump 53L, and is capable of changing a rotation speed (number of rotations) in accordance with a flow rate of the hydraulic fluid. A swash plate changeover cylinder 37L is connected to the left traveling motor 36L, and the rotation speed (number of rotations) of the left traveling motor 36L can also be changed by extending and contracting the swash plate changeover cylinder 37L in one and the other directions. That is, when the swash plate changeover cylinder 37L is contracted, the rotation speed of the left traveling motor 36L is set to a low speed stage (i.e., a first speed), and when the swash plate changeover cylinder 37L is extended, the rotation speed of the left traveling motor 36L is set to a high speed stage (i.e., a second speed). That is, the rotation speed of the left traveling motor 36L can be shifted between the first speed that is the low speed stage and the second speed that is the high speed stage.

The right traveling motor 36R is configured to be rotated by the hydraulic fluid delivered from the right traveling pump 53R, and is capable of changing a rotation speed (number of rotations) in accordance with a flow rate of the hydraulic fluid. A swash plate changeover cylinder 37R is connected to the right traveling motor 36R, and the rotation speed (number of rotations) of the right traveling motor 36R can also be changed by extending and contracting the swash plate changeover cylinder 37R in one and the other directions. That is, when the swash plate changeover cylinder 37R is contracted, the rotation speed of the right traveling motor 36R is set to a low speed stage (i.e., a first speed), and when the swash plate changeover cylinder 37R is extended, the rotation speed of the right traveling motor 36R is set to a high speed stage (second speed). That is, the rotation speed of the right traveling motor 36R can be shifted between the first speed that is the low speed stage and the second speed that is the high speed stage.

As shown in FIG. 1A, the hydraulic system for the working machine 1 includes a traveling switching valve 34. The traveling switching valve 34 is shiftable between a first state in which the rotation speeds (numbers of rotations) of the traveling motors (left traveling motor 36L and right traveling motor 36R) are set to the first speed and a second state in which the rotation speeds are set to the second speed. The traveling switching valve 34 includes first switching valves 71L and 71R and a second switching valve 72.

The first switching valve 71L is a two-position switching valve that is connected, via a fluid passage, to the swash plate changeover cylinder 37L of the left traveling motor 36L and configured to be shifted between a first position 71L1 and a second position 71L2. The first switching valve 71L contracts the swash plate changeover cylinder 37L when being in the first position 71L1, and extends the swash plate changeover cylinder 37L when being in the second position 71L2.

The first switching valve 71R is a two-position switching valve that is connected, via a fluid passage, to the swash plate changeover cylinder 37R of the right traveling motor 36R and configured to be shifted between a first position 71R1 and a second position 71R2. The first switching valve 71R contracts the swash plate changeover cylinder 37R when being in the first position 71R1, and extends the swash plate changeover cylinder 37R when being in the second position 71R2.

The second switching valve 72 is a two-position switching valve constituted of a solenoid valve that is configured to switch the first switching valve 71L and the first switching valve 71R and to be magnetized to shift between a first position 72*a* and a second position 72*b*. The second switching valve 72, the first switching valve 71L and the first switching valve 71R are connected by a fluid passage 41. The second switching valve 72 switches the first switching valve 71L and the first switching valve 71R respectively to the first positions 71L1 and 71R1 when being in the first position 72*a*, and switches the first switching valve 71L and the first switching valve 71R respectively to the second positions 71L2 and 71R2 when being in the second position 72*b*.

That is, when the second switching valve 72 is in the first position 72*a*, the first switching valve 71L is in the first position 71L1, and the first switching valve 71R is in the first position 71R1, the traveling switching valve 34 enters the first state, and thus rotation speeds of the traveling motors (left traveling motor 36L and right traveling motor 36R) become the first speed. When the second switching valve 72 is in the second position 72*b*, the first switching valve 71L is in the second position 71L2, and the first switching valve 71R is in the second position 71R2, the traveling switching valve 34 enters the second state, and thus rotation speeds of the traveling motors (left traveling motor 36L and right traveling motor 36R) become the second speed.

Accordingly, the traveling switching valve 34 allows the traveling motors (left traveling motor 36L and right traveling motor 36R) to switch between the first speed that is the low speed stage and the second speed that is the high speed stage.

The operation device 54 is a device for operating the traveling pumps (left traveling pump 53L and right traveling pump 53R) and is configured to change angles of the swash plates of the traveling pumps (swash plate angles). The operation device 54 includes a traveling operation member 59 and a plurality of operation valves 55.

The traveling operation member 59 is an operation lever that is supported by the operation valves 55 swingably in a lateral direction (machine width direction) or the fore-and-aft direction. That is, with reference to the neutral position N, the traveling operation member 59 is operable to the right or left from the neutral position N, and to the front or rear from the neutral position N. In other words, the traveling operation member 59 is swingable at least in four directions with reference to the neutral position N. For convenience of explanation, the two directions of the forward and backward directions, namely, the fore-and-aft direction, may be referred to as a first direction. The two directions of the rightward and leftward directions, namely, the lateral direction (machine width direction), may be referred to as a second direction.

The plurality of operation valves 55 are operated by a common, i.e., single traveling operation member 59. The plurality of operation valves 55 are actuated according to swinging of the traveling operation member 59. A delivery fluid passage 40 is connected to the plurality of operation valves 55, and the hydraulic fluid (pilot fluid) from the first hydraulic pump P1 can be delivered, through the delivery fluid passage 40, to the plurality of operation valves 55. The plurality of operation valves 55 include an operation valve 55A, an operation valve 55B, an operation valve 55C and an operation valve 55D.

The operation valve 55A changes a pressure of the hydraulic fluid to be output according to an operation amount (operation) of a forward operation thereof when the traveling operation member 59 is swung forward (to one side) in the fore-and-aft direction (first direction) (when the forward operation is performed). The operation valve 55B changes a pressure of the hydraulic fluid to be output according to an operation amount (operation) of a backward operation thereof when the traveling operation member 59 is swung backward (to the other side) in the fore-and-aft direction (first direction) (when the backward operation is performed). The operation valve 55C changes a pressure of the hydraulic fluid to be output according to an operation amount (operation) of a rightward operation thereof when the traveling operation member 59 is swung rightward (to one side) in the lateral direction (second direction) (when the rightward operation is performed). The operation valve 55D changes a pressure of the hydraulic fluid to be output according to an operation amount (operation) of a leftward operation thereof when the traveling operation member 59 is swung leftward (to the other side) in the lateral direction (second direction) (when the leftward operation is performed).

The plurality of operation valves 55 are connected to the traveling pumps (left traveling pump 53L and right traveling pump 53R) the traveling fluid passages 45. In other words, the traveling pumps (left traveling pump 53L and right traveling pump 53R) are hydraulic devices configured to be operated by the hydraulic fluid output from the operation valves 55 (operation valve 55A, operation valve 55B, operation valve 55C, operation valve 55D).

The traveling fluid passages 45 includes a first traveling fluid passage 45*a*, a second traveling fluid passage 45*b*, a third traveling fluid passage 45*c*, a fourth traveling fluid passage 45*d*, and a fifth traveling fluid passage 45*e*. The first traveling fluid passages 45*a* is a fluid passage connected to the forward-traveling pressure receiving portion 53*a* of the traveling pump 53L. The second traveling fluid passages 45*b* is a fluid passage connected to the backward-traveling pressure receiving portion 53*b* of the traveling pump 53L. The third traveling fluid passages 45*c* is a fluid passage connected to the forward-traveling pressure receiving portion 53*a* of the traveling pump 53R. The fourth traveling fluid passages 45*d* is a fluid passage connected to the backward-traveling pressure receiving portion 53*b* of the traveling pump 53R. The fifth traveling fluid passages 45*e* is a fluid passage connecting the operation valves 55, the first traveling fluid passage 45*a*, the second traveling fluid passage 45*b*, the third traveling fluid passage 45*c*, and the fourth traveling fluid passage 45*d*.

Figure 2:
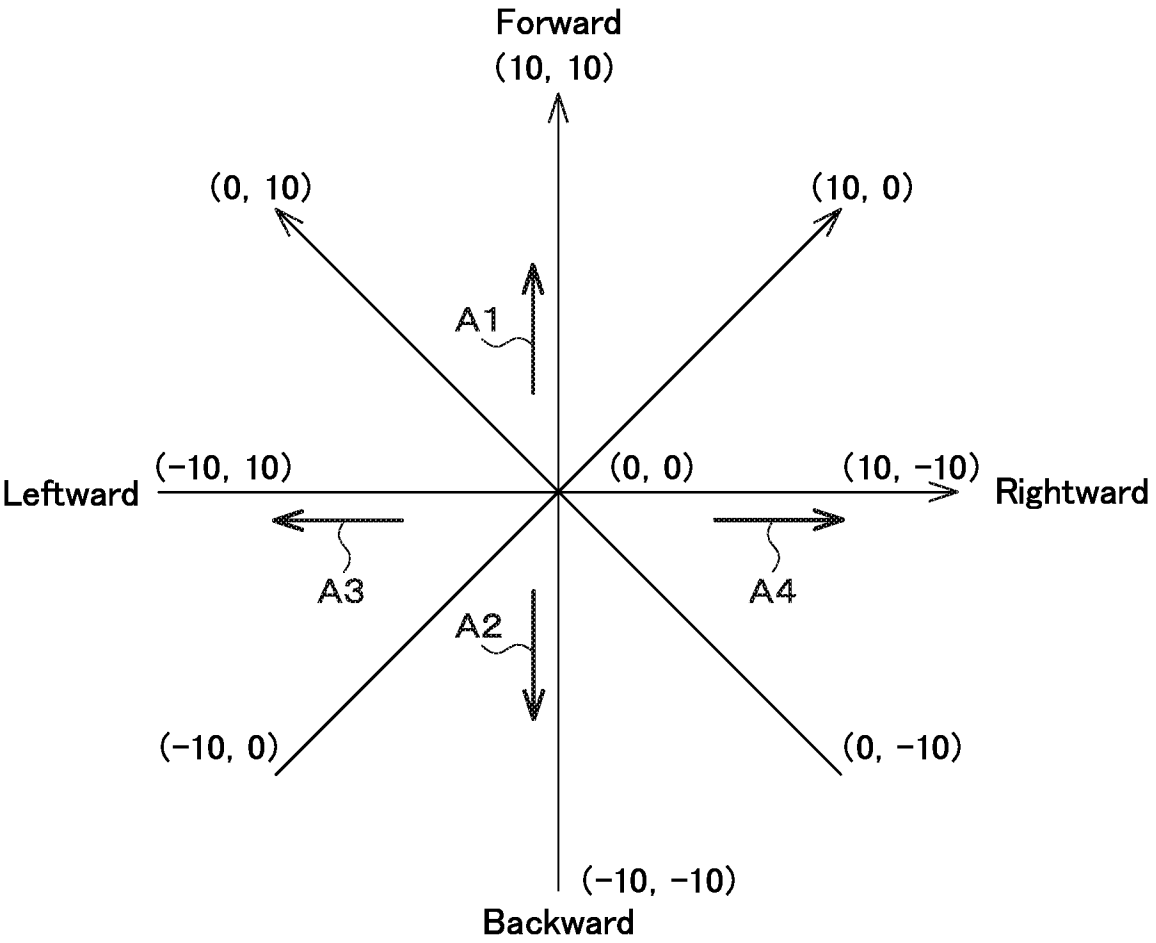
FIG. 2 is a view showing operation directions and the like of a traveling operation member.

When the traveling operation member 59 is swung forward (in a direction of an arrowed line A1 in FIG. 1A and FIG. 2), the operation valve 55A is operated to output a pilot pressure from the operation valve 55A. This pilot pressure is applied to the pressure receiving portion 53*a* of the left traveling pump 53L via the first traveling fluid passage 45*a* and to the pressure receiving portion 53*a* of the right traveling pump 53R via the third traveling fluid passage 45*c*. In this manner, the swash plate angles of the left traveling pump 53L and the right traveling pump 53R are changed, the left traveling motor 36L and the right traveling motor 36R rotate normally (forward rotation), and thus the working machine 1 travels straight forward. Numerical values in parentheses shown in FIG. 2 are examples of a speed in the leftward direction of the working machine 1 and a speed in the rightward direction of the working machine 1 when the traveling operation member 59 is operated; however, the numerical values are not limited thereto.

When the traveling operation member 59 is swung backward (in a direction of an arrowed line A2 in FIG. 1A and FIG. 2), the operation valve 55B is operated to output a pilot pressure from the operation valve 55B. This pilot pressure is applied to the pressure receiving portion 53*b* of the left traveling pump 53L via the second traveling fluid passage 45*b* and to the pressure receiving portion 53*b* of the right traveling pump 53R via the fourth traveling fluid passage 45*d*. In this manner, the swash plate angles of the left traveling pump 53L and the right traveling pump 53R are changed, the left traveling motor 36L and the right traveling motor 36R rotate reversely (backward rotation), and thus the working machine 1 travels straight backward.

When the traveling operation member 59 is swung rightward (in a direction of an arrowed line A3 in FIG. 1A and FIG. 2), the operation valve 55C is operated to output a pilot pressure from the operation valve 55C. This pilot pressure is applied to the pressure receiving portion 53*a* of the left traveling pump 53L via the first traveling fluid passage 45*a* and to the pressure receiving portion 53*b* of the right traveling pump 53R via the fourth traveling fluid passage 45*d*. In this manner, the swash plate angles of the left traveling pump 53L and the right traveling pump 53R are changed, the left traveling motor 36L rotates normally, the right traveling motor 36R rotates reversely, and thus the working machine 1 makes a rightward spin turn (spin turn).

When the traveling operation member 59 is swung leftward (in a direction of an arrowed line A4 in FIG. 1A and FIG. 2), the operation valve 55D is operated to output a pilot pressure from the operation valve 55D. This pilot pressure is applied to the pressure receiving portion 53*a* of the right traveling pump 53R via the third traveling fluid passage 45*c* and to the pressure receiving portion 53*b* of the left traveling pump 53L via the second traveling fluid passage 45*b*. In this manner, the swash plate angles of the left traveling pump 53L and the right traveling pump 53R are changed, the left traveling motor 36L rotates reversely, the right traveling motor 36R rotates normally, and thus the working machine 1 makes a leftward spin turn (spin turn).

In addition, when the traveling operation member 59 is swung in an oblique direction, rotational directions and rotational speeds of the left traveling motor 36L and the right traveling motor 36R are determined by a differential pressure of the pilot pressures applied to the pressure receiving portion 53*a* and the pressure receiving portion 53*b*, and thus the working machine 1 makes a right pivot turn or a left pivot turn while traveling forward or backward.

That is, when the traveling operation member 59 is operated to be swung forward obliquely to the left, the working machine 1 turns left while traveling forward at a speed corresponding to a swing angle of the traveling operation member 59. When the traveling operation member 59 is operated to be swung forward obliquely to the right, the working machine 1 turns right while traveling forward at a speed corresponding to a swing angle of the traveling operation member 59. When the traveling operation member 59 is operated to be swung backward obliquely to the left, the working machine 1 turns left while traveling backward at a speed corresponding to a swing angle of the traveling operation member 59. When the traveling operation member 59 is operated to be swung backward obliquely to the right, the working machine 1 turns right while traveling backward at a speed corresponding to a swing angle of the traveling operation member 59.

As shown in FIG. 1A, the working machine 1 includes a controller 60. The controller 60 performs various controls of the working machine 1 and is constituted of a semiconductor such as a CPU or an MPU, electrical/electronic circuits, or the like. The controller 60 is connected to an accelerator 65, a mode switch 66, a speed-shifting switch 67, and rotation speed detectors 68.

The mode switch 66 is a switch that allows or disables the automatic speed reduction. For example, the mode switch 66 is a switch that can be shifted between an on state and an off state; the mode switch 66 allows the automatic speed reduction when being in the on state, and disables the automatic speed reduction when being in the off state.

The speed-shifting switch 67 is disposed in the vicinity of the driver's seat 8 and can be operated by a driver (operator). The speed-shifting switch 67 is a switch that can be used to manually switch the traveling motors (left traveling motor 36L and right traveling motor 36R) to either the first speed or the second speed. For example, the speed-shifting switch 67 is a see-saw switch that performs switching between the first speed stage and the second speed stage, and can be used to perform a speed increase operation for switching from the first speed stage to the second speed stage and a speed reduction operation for switching from the second speed stage to the first speed stage.

The rotation speed detectors 68 are constituted of sensors or the like that detect the rotation speeds; the rotation speed detectors 68 detect rotation speeds of motors, that is, current rotation speeds of the traveling motors (left traveling motor 36L and right traveling motor 36R). Specifically, the rotation speed detectors 68 are disposed on respective rotation shafts or the like of the left traveling motor 36L and the right traveling motor 36R; the rotation speed detectors 68 are capable of detecting a motor rotation speed of the left traveling motor 36L (left motor rotation speed) and a motor rotation speed of the right traveling motor 36R (right motor rotation speed), respectively.

The rotation speed detectors 68 may be, for example, swash-plate angle sensors configured to detect (measure) angles of the swash plates of the traveling pumps 53 (left traveling pump 53L and right traveling pump 53R). That is, the swash plate angles of the traveling pumps 53L and 53R may be detected by the swash-plate angle sensors, and the motor rotation speeds may be obtained based on the detected swash plate angles (delivery amounts of the traveling pumps 53L and 53R).

The controller 60 includes an automatic speed reduction unit 61. The automatic speed reduction unit 61 is constituted of an electrical/electronic circuit or the like provided in the controller 60, a computer program stored in the controller 60, or the like.

The automatic speed reduction unit 61 performs an automatic speed reduction control when auto deceleration is enabled, and does not perform the automatic speed reduction control when the automatic speed reduction is disabled.

In the automatic speed reduction control, when a predetermined condition (automatic speed reduction condition) is satisfied in a state where the traveling motors (left traveling motor 36L and right traveling motor 36R) are at the second speed, the traveling motors (left traveling motor 36L and right traveling motor 36R) are automatically shifted from the second speed to the first speed. In the automatic speed reduction control, when the automatic speed reduction condition is satisfied at least in a state where the traveling motors (left traveling motor 36L and right traveling motor 36R) are at the second speed, the controller 60 demagnetizes a solenoid of the second switching valve 72 to shift the second switching valve 72 from the second position 72*b* to the first position 72*a*, thereby reducing speeds of the traveling motors (left traveling motor 36L and right traveling motor 36R) from the second speed to the first speed. That is, the controller 60 reduces the speeds of both of the left traveling motor 36L and the right traveling motor 36R from the second speed to the first speed when the automatic speed reduction is performed under the automatic speed reduction control.

When a return condition is satisfied after the automatic speed reduction has been performed, the automatic speed reduction unit 61 magnetizes the solenoid of the second switching valve 72 to shift the second switching valve 72 from the first position 72*a* to the second position 72*b*, thereby increasing speeds of the traveling motors (left traveling motor 36L and right traveling motor 36R) from the first speed to the second speed, that is, returning the speeds of the traveling motors. That is, the controller 60 increases the speeds of both of the left traveling motor 36L and the right traveling motor 36R from the first speed to the second speed in a case of returning from the first speed to the second speed.

When the automatic speed reduction is disabled, the controller 60 performs a manual shifting control to shift the traveling motors (left traveling motor 36L and right traveling motor 36R) to either the first speed or the second speed according to an operation of the speed-shifting switch 67. In the manual shifting control, when the speed-shifting switch 67 is shifted to the first speed stage, the solenoid of the second switching valve 72 is demagnetized to shift the traveling motors (left traveling motor 36L and right traveling motor 36R) to the first speed. In addition, in the manual shifting control, when the speed-shifting switch 67 is switched to the second speed stage, the solenoid of the second switching valve 72 is magnetized to shift the traveling motors (left traveling motor 36L and right traveling motor 36R) to the second speed.

Now, as shown in FIG. 1A, the working machine 1 includes an operation detector 64 and a memory device 69. The operation detector 64 is a device configured to detect an operation amount of the traveling operation member 59, and is constituted of, for example, a potentiometer for detecting a swing amount of the traveling operation member 59. The operation detector 64 may also be a pressure sensor installed on (connected to) the traveling fluid passages 45.

As shown in FIG. 2, when the traveling operation member 59 is gradually tilted from the neutral state, the operation detector 64 detects the operation amount according to a magnitude of the tilting. The operation detector 64 is capable of detecting the operation amount in both of a case where the traveling operation member 59 is tilted forward or backward and a case where the traveling operation member 59 is tilted leftward or rightward.

Figure 3:
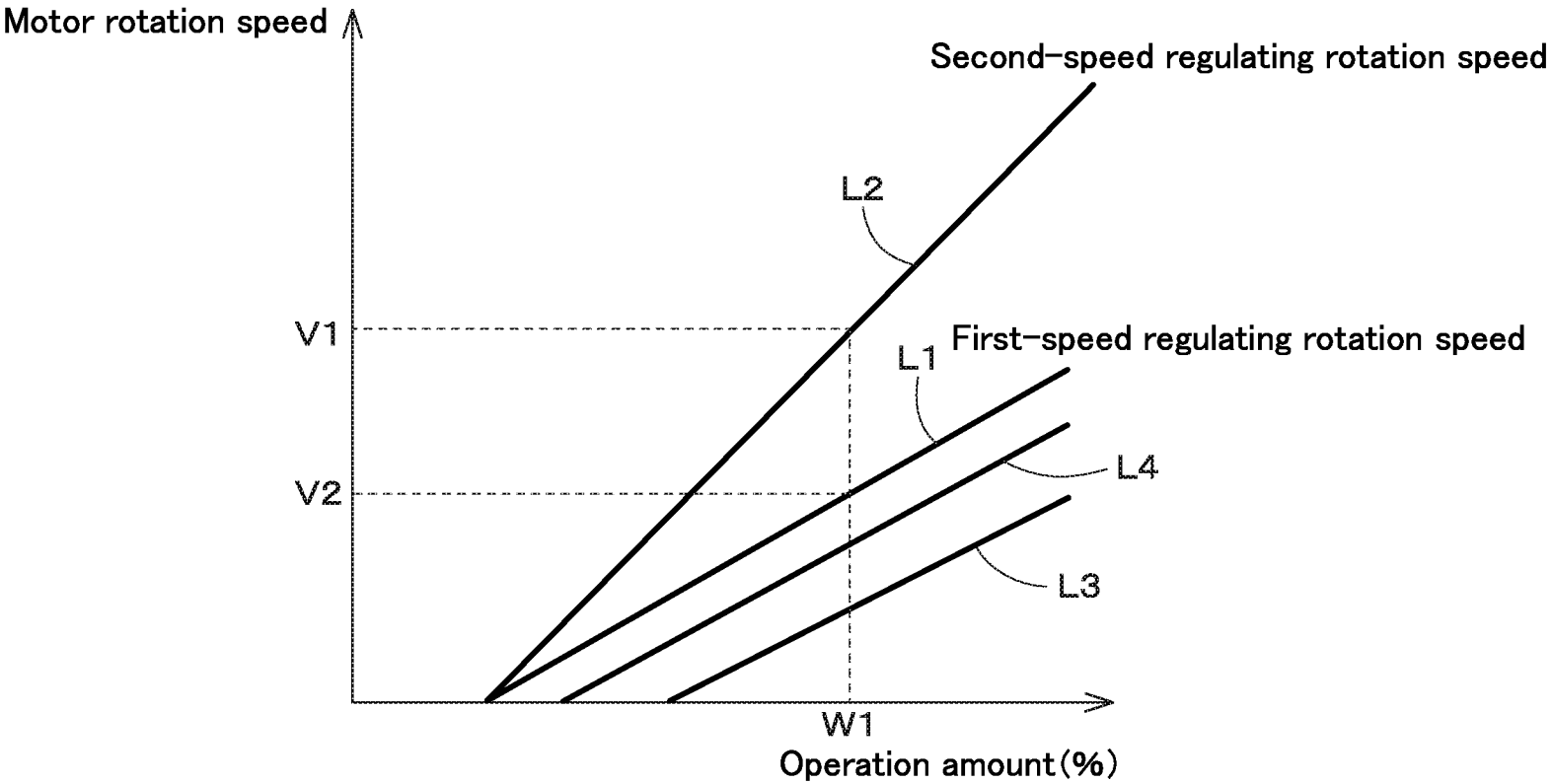
FIG. 3 is a view showing an example of first control information.

The memory device 69 is constituted of a non-volatile memory or the like and stores control information (first control information). As shown in FIG. 3, the control information (first control information) is information representing a relationship between the operation amount of the traveling operation member 59 and the motor rotation speeds of the traveling motors (left traveling motor 36L and right traveling motor 36R). The first control information is information indicated by numerical values, functions, control lines, tables, and/or the like.

Specifically, the first control information includes a first-speed regulating rotation speed corresponding to an operation amount of the traveling operation member 59 in a state where the speed of the working machine 1 is the first speed, and the first-speed regulating rotation speed is set, for example, by a first speed line L1. In addition, the first control information includes a second-speed regulating rotation speed corresponding to an operation amount of the traveling operation member 59 in a state where the speed of the working machine 1 is the second speed, and the second-speed regulating rotation speed is set, for example, by a second speed line L2.

An increasing amount of the first-speed regulating rotation speed per predetermined operation amount on the first speed line L1 is smaller than an increasing amount of the second-speed regulating rotation speed per predetermined operation amount on the second speed line L2. That is, a slope of the second speed line L2 is greater than that of the first speed line L1.

In the case where the traveling motors (left traveling motor 36L and right traveling motor 36R) are at the second speed, the automatic speed reduction unit 61 obtains, based on an operation amount detected by the operation detector 64 and the first control information, the first-speed regulating rotation speed set by the first speed line L1. And, when the motor rotation speed (actual motor rotation speed) detected by the rotation speed detector 68 is not higher than the first-speed regulating rotation speed, the automatic speed reduction unit 61 performs the automatic speed reduction (speed reduction from the second speed to the first speed). For example, as shown in FIG. 3, when an operation amount of the traveling operation member 59 is "W1" in the case where the traveling motors are at the second speed, the second-speed regulating rotation speed (maximum rotation speed) of the traveling motor becomes "V1" represented by the second speed line L2. Here, when actual motor rotation speeds of the traveling motors are reduced to be equal to or less than "V2" indicated by the first speed line L1 while an operation amount of the traveling operation member 59 is maintained at "W1", the automatic speed reduction unit 61 performs the automatic speed reduction. On the other hand, the automatic speed reduction unit 61 returns the traveling motors from the first speed to the second speed when the actual motor rotation speed becomes, after the automatic speed reduction, equal to or higher than a return threshold.

As shown in FIG. 3, the first control information includes a third speed line L3 and a fourth speed line L4 in addition to the first speed line L1 and the second speed line L2. The third speed line L3 is a line that sets a speed reduction threshold that is equal to or less than the first-speed regulating rotation speed defined by the first speed line L1. The fourth speed line L4 is a line that sets the return threshold that is equal to or less than the first-speed regulating rotation speed defined by the first speed line L1 and is equal to or greater than the speed reduction threshold defied by the third speed line L3. In other words, the memory device 69 stores the speed reduction threshold preliminarily determined as being at or below the first-speed regulating rotation speed, and stores the return threshold determined as being at or below the first-speed regulating rotation speed and at or above the speed reduction threshold.

The automatic speed reduction unit 61 performs the automatic speed reduction when an actual motor rotation speed is equal to or less than the speed reduction threshold defined by the third speed line L3 in the case where the traveling motors are at the second speed. In addition, the automatic speed reduction unit 61 returns the traveling motors from the first speed to the second speed when an actual motor rotation speed becomes, after the automatic speed reduction, equal to or greater than the return threshold defined by the fourth speed line L4.

Figure 4:
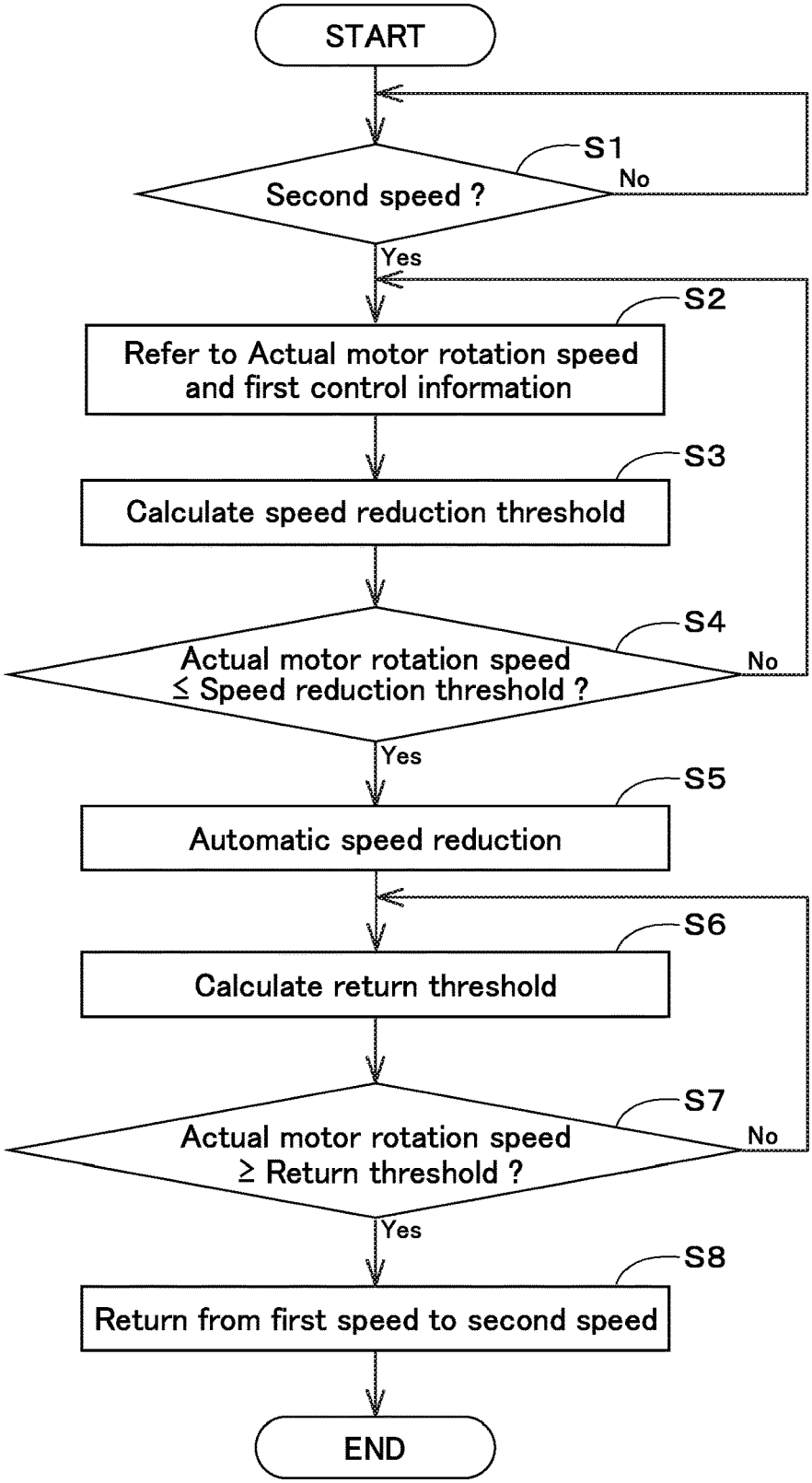
FIG. 4 is a view showing processes in an automatic speed reduction unit.

FIG. 4 is a view summarizing the process in the automatic speed reduction unit 61.

As shown in FIG. 4, in a state where the automatic speed reduction is allowed and the traveling motors are at the second speed (S1, Yes), the automatic speed reduction unit 61 refers to an actual motor rotation speed detected by the rotation speed detector 68 and the first control information (S2). The automatic speed reduction unit 61 calculates the speed reduction threshold based on an operation amount detected by the operation detector 64 and the third speed line L3 (S3). The automatic speed reduction unit 61 judges whether the actual motor rotation speed is equal to or less than the speed reduction threshold or not (S4). When the actual motor rotation speed is equal to or less than the speed reduction threshold (S4, Yes), the automatic speed reduction unit 61 performs the automatic speed reduction (S5).

After performing the automatic speed reduction, the automatic speed reduction unit 61 calculates the return threshold based on an operation amount detected by the operation detector 64 and the fourth speed line L4 (S6). The automatic speed reduction unit 61 judges whether the actual motor rotation speed is equal to or greater than the return threshold or not (S7). When the actual motor rotation speed is equal to or less than the return threshold (S7, Yes), the automatic speed reduction unit 61 returns the traveling motors from the first speed to the second speed (S8).

In the case of a spin turn (neutral turn) in which one of the left traveling motors 36L and the right traveling motor 36R rotates normally and the other rotates reversely, the automatic speed reduction unit 61 performs the automatic speed reduction when either a left motor rotation speed of the left traveling motor 36L or a right motor rotation speed of the right traveling motor 36R becomes equal to or less than the first-speed regulating rotation speed. That is, when either the left motor rotation speed or the right motor rotation speed becomes equal to or less than the motor rotation speed defined by the third speed line L3 (equal to or less than the speed reduction threshold) in a spin turn, the automatic speed reduction is performed.

In the spin turn, the automatic speed reduction unit 61 returns the traveling motors from the first speed to the second speed when motor rotation speeds of both of the left traveling motor 36L and the right traveling motor 36R become equal to or greater than the return threshold defined by the fourth speed line L4.

In the above-described embodiment, the automatic speed reduction unit 61 performs the automatic speed reduction from the second speed to the first speed when both of the pair of traveling motors (left traveling motor 36L and right traveling motor 36R) are at the second speed; however, the automatic speed reduction unit 61 may perform the automatic speed reduction when either one of the pair of traveling motors (left traveling motor 36L and right traveling motor 36R) is at the second speed. In addition, the automatic speed reduction unit 61 may perform the automatic speed reduction from the first speed to the second speed after the automatic speed reduction has been performed in any one of the pair of traveling motors (left traveling motor 36L and right traveling motor 36R).

Figure 5:
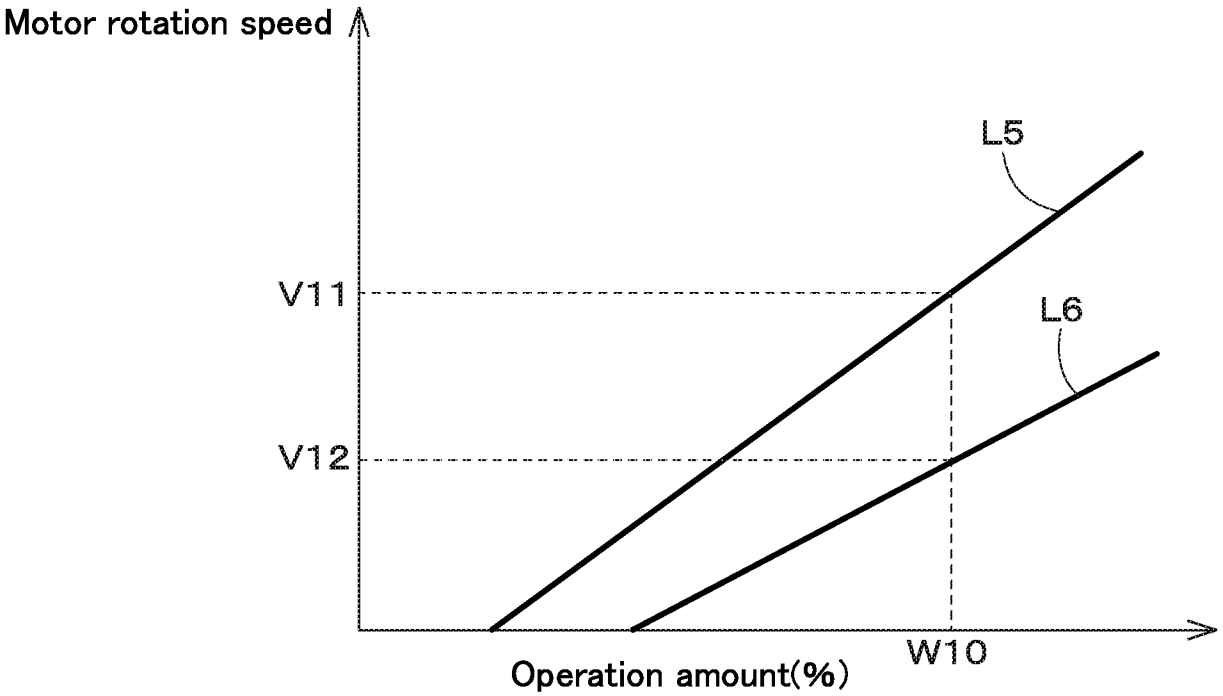
FIG. 5 is a view showing an example of second control information.

FIG. 5 shows other control information (second control information). In an embodiment shown in FIG. 5, explanations are omitted for the same configurations as those of the above-described embodiment. The control information according to the embodiment shown in FIG. 5 is also information showing a relationship between an operation amount of the traveling operation member 59 and motor rotation speeds of the traveling motors (left traveling motor 36L and right traveling motor 36R). The second control information is information indicated by numerical values, functions, control lines, tables, and/or the like.

The memory device 69 stores, as the second control information, a fifth speed line L5 and a sixth speed line L6. The fifth speed line L5 is a line showing a relationship between an operation amount of the traveling operation member 59, a motor rotation speed, and the speed reduction threshold. The sixth speed line L6 is a line showing a relationship between an operation amount of the traveling operation member 59, a motor rotation speed, and the return threshold.

In a case where the traveling motors 36 (left traveling motor 36L and right traveling motor 36R) are at the second speed and both of the traveling motors 36 (left traveling motor 36L and right traveling motor 36R) rotate normally (travel forward), the automatic speed reduction unit 61 obtains the speed reduction threshold based on an operation amount detected by the operation detector 64 and on the fifth speed line L5, and the automatic speed reduction unit 61 performs the automatic speed reduction when an actual motor rotation speed becomes equal to or less than the speed reduction threshold. For example, as shown in FIG. 5, when an operation amount of the traveling operation member 59 is "W10", the speed reduction threshold is "V11" represented by the fifth speed line L5. Here, in a case where the working machine 1 travels forward (travels straight) in a state where the operation amount of the traveling operation member 59 is maintained at "W10", the automatic speed reduction unit 61 performs the automatic speed reduction when the actual motor rotation speeds of both of the left traveling motor 36L and the right traveling motor 36R are reduced and when the actual motor rotation speeds of both of them become equal to or less than the speed reduction threshold V11.

On the other hand, after the automatic speed reduction, when the traveling motors (left traveling motor 36L and right traveling motor 36R) are at the first speed and when both of the traveling motors (left traveling motor 36L and right traveling motor 36R) rotate normally (travel forward), the automatic speed reduction unit 61 obtains the return threshold based on an operation amount detected by the operation detector 64 and the sixth speed line L6, and, when an actual motor rotation speed becomes equal to or greater than a return threshold V12, the automatic speed reduction unit 61 returns the traveling motors from the first speed to the second speed.

For example, as shown in FIG. 5, when the actual motor rotation speed increases while the working machine 1 is traveling forward after the automatic speed reduction with the operation amount maintained at "W10" and then the actual motor rotation speed of either the left traveling motor 36L or the right traveling motor 36R becomes equal to or greater than the return threshold V12, the automatic speed reduction unit 61 returns the traveling motors from the first speed to the second speed.

In the second embodiment, the automatic speed reduction and the returning have been described, the automatic speed reduction and the returning being performed in the case where both of the traveling motors (left traveling motor 36L and right traveling motor 36R) rotate normally (travel forward); however, the same operation is performed in a case where both of the traveling motors (left traveling motor 36L and right traveling motor 36R) rotate reversely (travel backward). That is, in the second embodiment, the case of normal rotating (traveling forward) should be replaced with the case of reverse rotating (traveling backward).

The working machine includes the machine body 2, the pair of traveling devices 5L and 5R, the traveling operation member 59, the pair of traveling motors (left traveling motor 36L, right traveling motor 36R), the pair of traveling pumps 53L and 53R, the controller 60 having the rotation speed detector 68, the operation detector 64, the automatic speed reduction unit 61, and the memory device 69 storing the second control information. When at least one of the pair of traveling motors is at the second speed and both of the pair of traveling motors are rotating normally or reversely, the automatic speed reduction unit 61 obtains the speed reduction threshold based on an operation amount detected by the operation detector 64 and the second control information. And, when the motor rotation speed detected by the rotation speed detector 68 is not more than the speed reduction threshold, the automatic speed reduction unit 61 performs the automatic speed reduction. According to this configuration, the automatic speed reduction can be performed steeply when a load is applied in a state where the working machine 1 performs the normal rotating (traveling forward) or the reverse rotating (traveling backward) at the second speed.

The memory device 69 stores the second control information representing a relationship between an operation amount of the traveling operation member 59, a motor rotation speed, and the return threshold. When, after the automatic speed reduction, both of the pair of traveling motors are rotating normally or reversely, the automatic speed reduction unit 61 obtains the return threshold based on an operation amount detected by the operation detector 64 and the second control information. And, when the motor rotation speed detected by the rotation speed detector 68 is not less than the return threshold, the automatic speed reduction unit 61 returns the traveling motors from the first speed to the second speed. According to this configuration, the returning can be performed steeply when the motor rotation speed becomes equal to or greater than the return threshold after the automatic speed reduction has been performed in the forward traveling or the backward traveling.

As described above, since the second speed need only be faster than the first speed, the shifting steps of the working machine is not limited to two steps, and multiple steps (a plurality of steps) can be adopted to the working machine.

In the above-described embodiment, the left traveling motor 36L and the right traveling motor 36R are simultaneously shifted to the first speed or the second speed, and the automatic speed reduction is also performed simultaneously for the left traveling motor 36L and the right traveling motor 36R. However, at least one of the left traveling motor 36L and the right traveling motor 36R may be shifted to the first speed or the second speed, and the automatic speed reduction may be performed for at least one of the left traveling motor 36L and the right traveling motor 36R set as being at the second speed.

In addition, the traveling motors (left traveling motor 36L and right traveling motor 36R) may be axial piston motors or may be radial piston motors. Regardless of whether the traveling motors are radial piston motors or radial piston motors, the motors can be shifted to the first speed by increasing motor capacities thereof, and can be shifted to the second speed by reducing the motor capacities.

Next, the automatic speed reduction control will be described below; the automatic speed reduction control is to be performed when an operation amount of the traveling operation member 59 is changed at a fast rate (steeply and instantaneously) from the first operation amount W11 to the second operation amount W12 shown in FIG. 6.

Figure 6:
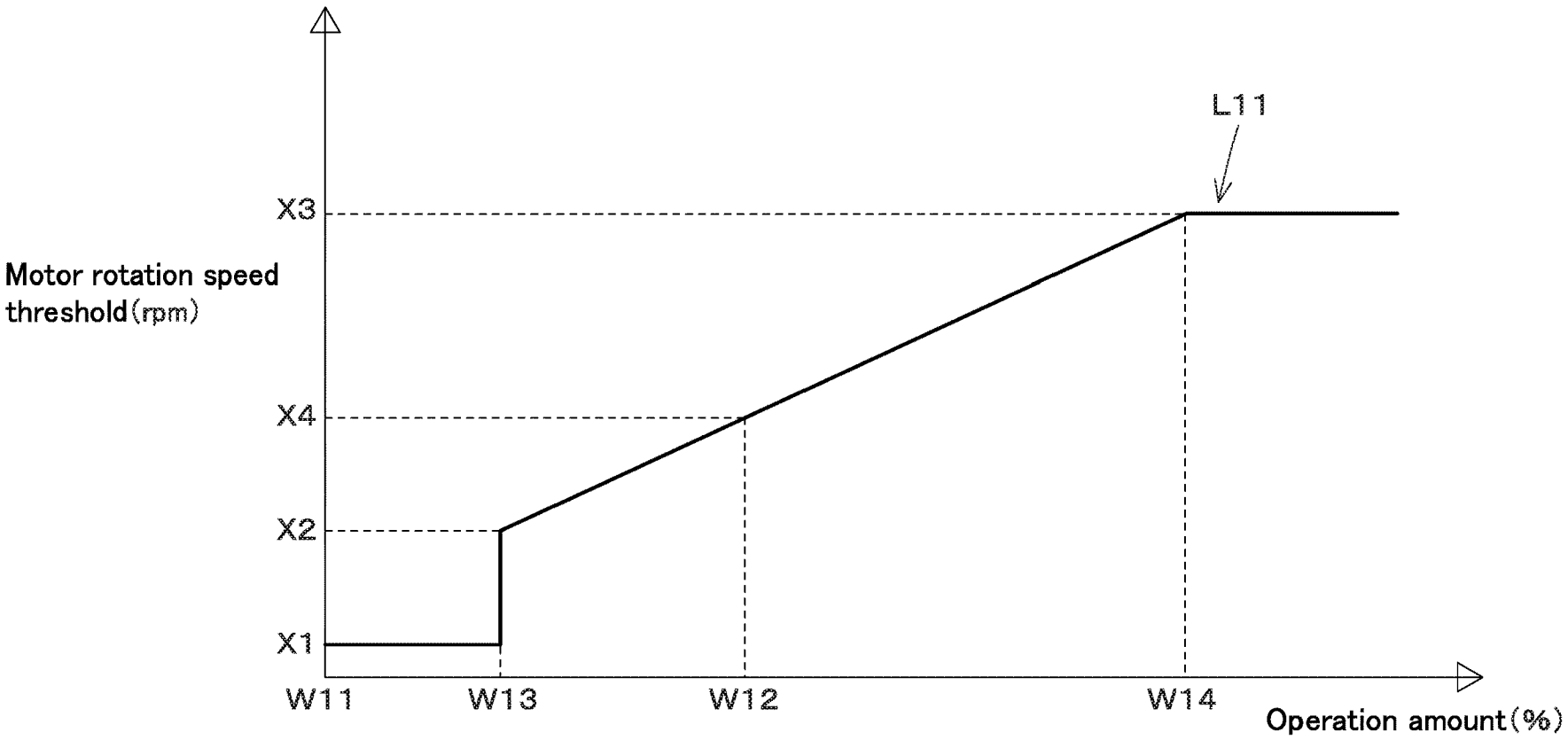
FIG. 6 is a view showing a relationship between an operation amount and a motor rotation speed threshold.

FIG. 6 shows a relationship between an operation amount of the traveling operation member 59 and the motor rotation speed threshold (speed reduction threshold). The motor rotation speed threshold is a threshold set based on an operation amount of the traveling operation member 59, and also is a threshold that serves as a boundary in the motor rotation speed, the boundary being used for determination whether to perform the automatic speed reduction by the automatic speed reduction unit 61. That is, when the traveling motor 36 is at the second speed, the automatic speed reduction unit 61 performs the automatic speed reduction when an actual motor rotation speed detected by the rotation speed detector 68 falls below the motor rotation speed threshold.

In FIG. 6, a horizontal axis represents an operation amount of the traveling operation member 59, and a vertical axis represents the motor rotation speed threshold. In addition, in FIG. 6, the first operation amount W11 is an operation amount determined when the traveling operation member 59 is in the neutral position. That is, in the example shown in FIG. 6, the first operation amount W11 corresponds to 0% of the operation amount. FIG. 6 also shows, by a first threshold line L11, the motor rotation speed threshold corresponding to an operation amount of the traveling operation member 59 when a rotation speed of the prime mover 32 is 2400 rpm, for example. That is, the first threshold line L11 shows a transition of the motor rotation speed threshold corresponding to a transition of the operation amount of the traveling operation member 59. The motor rotation speed threshold can be set and changed according to the rotation speed of the prime mover 32.

In FIG. 6, the controller 60 determines that the traveling operation member 59 is neutral (in the neutral position) when the operation amount of the traveling operation member 59 falls below a neutral judgment amount W13 that is an operation amount determined by a predetermined operation amount from the first operation amount W11. And, when the traveling operation member 59 is neutral, the motor rotation speed threshold corresponding to the operation amount of the traveling operation member 59 is set as small as possible (in the drawing, set to a first threshold value X1 rpm).

In the automatic speed reduction control according to the embodiment, when an operation amount of the traveling operation member 59 is lower than the neutral judgment amount W13 (in a neutral judgment area), the automatic speed reduction unit 61 disables the automatic speed reduction (prohibits the automatic speed reduction). That is, when the traveling operation member 59 is neutral, the controller 60 keeps the automatic speed reduction from being performed.

When an operation amount of the traveling operation member 59 is at the neutral judgment amount W13, the motor rotation speed threshold is set to a second threshold X2 rpm that is higher than the first threshold X1 rpm. When the operation amount of the traveling operation member 59 increases from the neutral judgment amount W13, the motor rotation speed threshold increases from the second threshold X2 rpm in proportion to the increase in the operation amount. And, when the operation amount of the traveling operation member 59 reaches the maximum operation amount W14, the motor rotation speed threshold is fixed at a third threshold X3 rpm.

Figure 7:
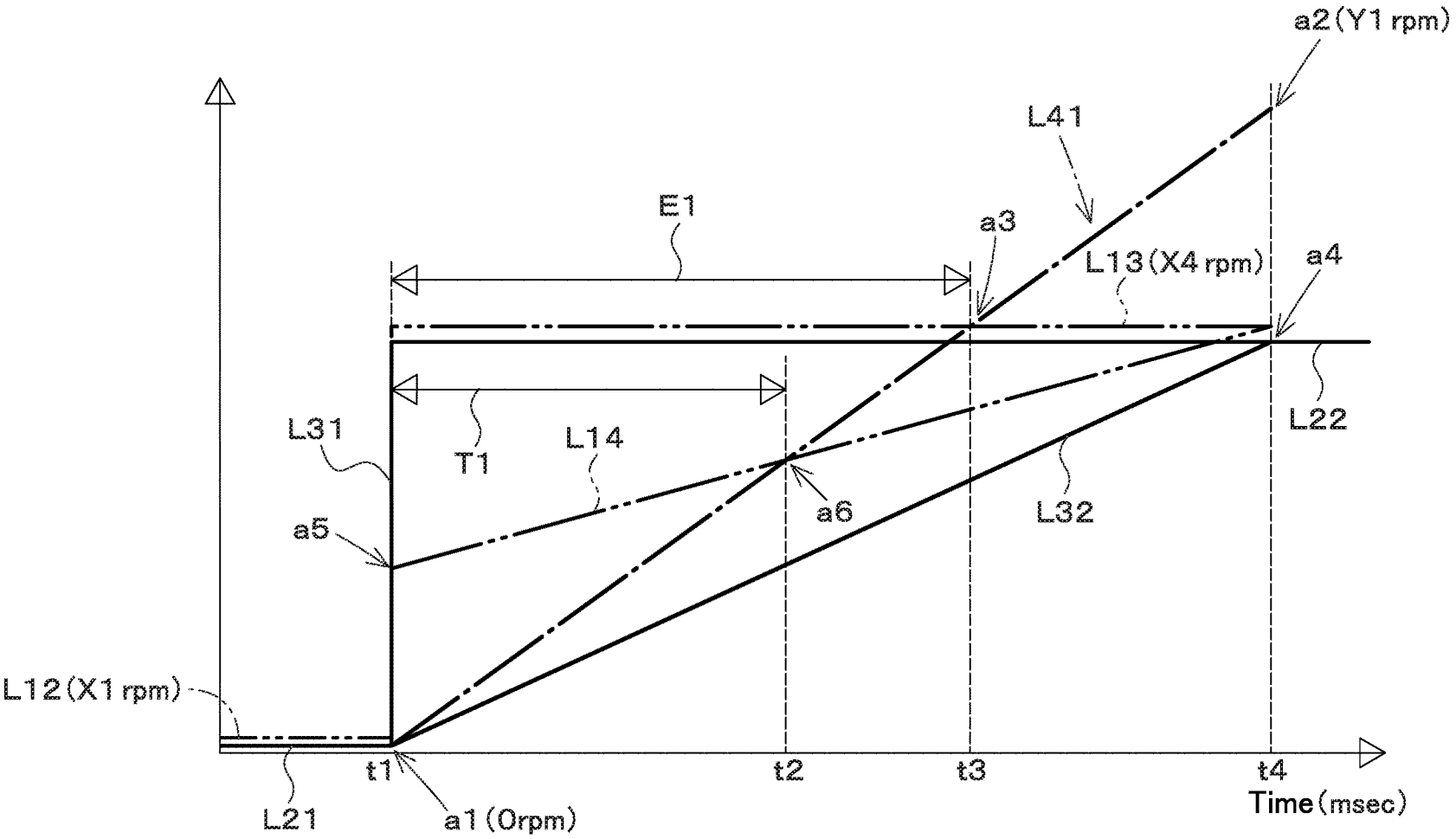
FIG. 7 is a view showing a restraining control for automatic speed reduction.

FIG. 7 shows a control to be performed by the controller 60 when the operation amount of the traveling operation member 59 is changed at a fast rate (steeply and instantaneously) from the first operation amount W11 (neutral position) to the second operation amount W12. In detail, FIG. 7 shows a state where the traveling operation member 59 is shifted from the first operation amount W11 to the second operation amount W12 and then fixed at the second operation amount W12.

FIG. 7 shows, with the horizontal axis showing time, a relationship among an actual operation amount of the traveling operation member 59, the motor rotation speed threshold corresponding to the actual operation amount of the traveling operation member 59 (the original motor rotation speed threshold), an actual change rate of the operation amount of the traveling operation member 59, a virtual change rate of the operation amount calculated by the controller 60, and a virtual motor rotation speed threshold calculated by the controller 60, and a transition of the motor rotation speed corresponding to the actual operation amount of the traveling operation member 59.

As shown in FIG. 6, the motor rotation speed threshold is the first threshold X1 rpm for the first operation amount W11, and is a fourth threshold X4 rpm for the second operation amount W12. In FIG. 7, the first threshold X1 rpm is shown by a second threshold line L12, and the fourth threshold X4 rpm is shown by a third threshold line L13.

In addition, a motor rotation speed line L41 shown in FIG. 7 represents a transition of the motor rotation speed to be set corresponding to an operation amount of the traveling operation member 59. A starting point a1 of this motor rotation speed line L41 is a starting point of operation of the traveling operation member 59, and the motor rotation speed at the starting point a1 is a rotation speed corresponding to the first operation amount W11. That is, in the example shown in the drawing, the motor rotation speed at the starting point a1 of the motor rotation speed line L41 is 0 rpm. The motor rotation speed Y1 rpm at an ending point a2 of the motor rotation speed line L41 is a rotation speed corresponding to the second operation amount W12. In addition, the motor rotation speed line L41 is an increasing sloping shape that gradually increases with the passage of time from a time t1 at the starting point a1 to a time t4 at the ending point a2.

As found in this motor rotation speed line L41, the motor rotation speed does not immediately become the motor rotation speed Y1 rpm corresponding to the second operation amount W12 even when an operation amount of the traveling operation member 59 is changed from the first operation amount W11 to the second operation amount W12, and it takes a predetermined period (time t1 to time t4) after the traveling operation member 59 has been operated. That is, when an operation amount of the traveling operation member 59 is changed steeply from the first operation amount W11 to the second operation amount W12, the motor rotation speed gradually increases, with the passage of time from the starting point a1, to the motor rotation speed Y1 rpm corresponding to the second operation amount W12.

Accordingly, as shown in FIG. 7, the third threshold line L13 (the original motor rotation speed threshold) is higher than the motor rotation speed line L41 until the motor rotation speed line L41 intersects the third threshold line L13 at an intersection point a3 after an operation time of the traveling operation member 59 has passed from the time t1 to a time t3. That is, while the operation time of the traveling operation member 59 passes from time t1 to time t3, the motor rotation speed threshold (fourth threshold X4 rpm) is higher than the motor rotation speed. Accordingly, when the traveling operation member 59 is operated from the neutral position (starting from a state of stopping the traveling) in a state where the traveling motor 36 is at the second speed and, a phenomenon may occur in which the automatic speed reduction unit 61 automatically reduces speeds of the traveling motors 36 from the second speed to the first speed in a region E1 under the time t3 even though the motor rotation speed is increasing in response to an operation amount of the traveling operation member 59 (even though the motor rotation speed is steadily increasing).

In the present embodiment, with respect to the actual change rate of the operation amount of the traveling operation member 59, in the control, a virtual change rate of the operation amount, which has a time delay that increases as the operation amount increases, is calculated, and a virtual motor rotation speed threshold corresponding to this virtual change rate of the operation amount is calculated. In this manner, the automatic speed reduction is prevented from being performed accidentally.

To be described specifically, in FIG. 7, the first operation amount W11 is shown by a first operation amount line L21, and the second operation amount W12 is shown by a second operation amount line L22. In addition, the actual change rate of the operation amount determined when the operation amount is changed from the first operation amount W11 to the second operation amount W12 is shown by a first change rate line L31. In the example shown in the drawing, the first change rate line L31 rises upward from the starting point a1. Since the time from the first operation amount W11 to the second operation amount W12 is extremely short, the first change rate line L31 is shown, in FIG. 7, so as to transit vertically upward.

As shown in FIG. 1A, the controller 60 includes an automatic speed reduction restraining unit 62 configured to restrain the automatic speed reduction from being performed when an operation amount of the traveling operation member 59 is changed steeply from the first operation amount W11 to the second operation amount W12.

Figure 8:
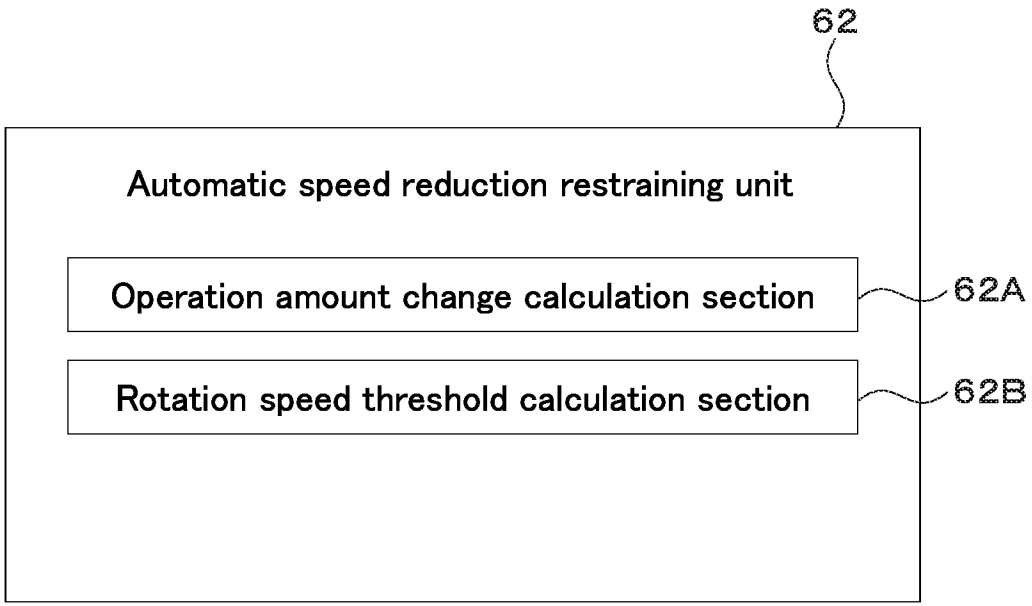
FIG. 8 is a view showing a restraining control for automatic speed reduction according to another example.

As shown in FIG. 8, the automatic speed reduction restraining unit 62 includes an operation amount change calculation section 62A and a rotation speed threshold calculation section 62B. The operation amount change calculation section 62A calculates a virtual change rate of the operation amount, which has a time delay that increases as the operation amount increases (as shifting from the first operation amount W11 to the second operation amount W12 in FIG. 7), with respect to the actual change rate of the operation amount (first change rate line L31). The rotation speed threshold calculation section 62B calculates the virtual motor rotation speed threshold corresponding to the virtual change rate of the operation amount calculated by the operation amount change calculation section 62A.

As shown in FIG. 7, the virtual change rate of the operation amount is represented by a second change rate line L32. The virtual motor rotation speed threshold corresponding to the virtual change rate of the operation amount (second change rate line L32) is represented by a fourth threshold line L14.

As shown in FIG. 7, while the first change rate line L31 rises upward from the starting point a1, the second change rate line L32 is set to be in an increasing sloping shape that increases from the starting point a1 to reach a point a4 on the second operation amount line L22 at a time t4. That is, even when the actual operation amount of the traveling operation member 59 is changed steeply from the first operation amount W11 to the second operation amount W12, the control set the operation amount of the traveling operation member 59 is be changed gently from the first operation amount W11 to the second operation amount W12.

Then, the fourth threshold line L14 is set so that the fourth threshold line L14 has an increasing sloping shape corresponding to the second change degree line L32. That is, in the control, the motor rotation speed threshold is set to change gently as an operation amount of the traveling operation member 59 increases from the first operation amount W11 until reaching the second operation amount W12. In the embodiment shown in FIG. 7, the starting point a5 of the fourth threshold line L14 is above the starting point a1 of the motor rotation speed line L41 (the rotation speed at the starting point a5 is set higher than the rotation speed at the starting point a1), and the fourth threshold line L14 intersects the motor rotation speed line L41 at a point a6 on the motor rotation speed line L41 at a time t2. Accordingly, from the time t1 to the time t2, the fourth threshold line L14 is located higher than the motor rotation speed line L41 (the virtual motor rotation speed threshold is a higher speed than the motor rotation speed).

For this reason, in the embodiment shown in FIG. 7, during a period from the time t1 to the time t2 (judgment time T1), the automatic speed reduction unit 61 does not judge whether the motor rotation speed is below the virtual motor rotation speed threshold. That is, in the embodiment shown in FIG. 7, the judgment time T1 is provided, which is a time until the automatic speed reduction unit 61 makes a judgment as to whether or not the motor rotation speed is below the virtual motor rotation speed threshold after the traveling operation member 59 is operated to change an operation amount from the first operation amount W11. In other words, the automatic speed reduction unit 61 is set to make a judgment as to whether or not the motor rotation speed falls below the virtual motor rotation speed threshold after a predetermined time (time t1 to time t2) has elapsed since the traveling operation member 59 is operated to change an operation amount from the first operation amount W11. This restrains accidental automatic speed reduction even when an operation amount of the traveling operation member 59 is operated steeply from the first operation amount W11 to the second operation amount W12. The judgment time T1 can be changed according to the motor rotation speed and variation in the second operation amount W12.

In the present embodiment, specifically, the automatic speed reduction control is performed in such a way that the current motor rotation speed is read after an operation amount of the traveling operation member 59 leaves the neutral judgment area, the judgment time T1 is set according to variation in the motor rotation speed, and then the mode is shifted to the automatic speed reduction judgment mode in which the automatic speed reduction unit 61 judges whether or not to perform the automatic speed reduction only after the set time has passed.

That is, as described above, it is prohibited to perform the automatic speed reduction in the neutral judgment area (in the neutral position); however, since the motor rotation speed may be small or a traveling pressure may be large just after leaving the neutral judgment area (neutral), it is not desired to perform the automatic speed reduction immediately after the starting of traveling. Thus, even after leaving the neutral judgment area (neutral), an automatic speed reduction prohibition section is provided in correspondence to variation in the motor rotation speed.

When an operation amount of the traveling operation member 59 exceeds the neutral judgment area (the traveling operation member 59 is no longer judged to be in the neutral position), the controller 60 calculates variation average (100 ms-variation average) that is an average of variation in the absolute values of the rotational speeds of the left traveling motor 36L and the right traveling motor 36R, and the controller 60 uses the variation average of the left and right traveling motors to calculate the time (judgment time T1: number of seconds) of the section for restraining judgment of the automatic speed reduction (automatic speed reduction in straight-traveling) in the starting of traveling, and to prohibit the automatic speed reduction (automatic speed reduction in straight-traveling) in the section where the judgment of automatic speed reduction is restrained.

Note that the judgment time T1 has passed once, the set judgment time T1 is not changed until an operation amount of the traveling operation member 59 is reset by entering the neutral judgment area next.

A purpose of the automatic speed reduction control according to the embodiment is to provide a function to reduce the speed to the first speed when the speed is reduced due to a load while the vehicle is traveling at the second speed, that is, when the vehicle can travel faster at the first speed as a result. Thus, in order to prevent the automatic speed reduction from being activated even though a vehicle traveling speed is above a certain speed, a function is provided to prohibit the automatic speed reduction when the motor rotation speed is equal to or more than a set value.

That is, when either the motor rotation speed of the left traveling motor 36L or the motor rotation speed of the right traveling motor 36R is higher, by a certain speed, than the 100 ms-variation average of the absolute values of rotation speeds of the left traveling motor 36L and the right traveling motor 36R, the automatic speed reduction (automatic speed reduction in straight-traveling) is prohibited.

The above-mentioned prohibition of the automatic speed reduction is performed when a vehicle speed is above the first speed or slightly below the first speed in a state where the vehicle speed is reduced due to a load applied during the traveling at the second speed. Since the vehicle speed varies depending on the prime mover rotation speed (engine rotation speed), a pilot pressure, and a traveling load (variation of draining flow rate from the relief valve), the set value for the vehicle speed is varied depending on the prime mover rotation speed (engine rotation speed).

In the embodiment shown in FIG. 7, a case is described where the first operation amount W11 is defined as an operation amount representing a state where the traveling operation member 59 is in the neutral position; however, the first operation amount W11 is not limited thereto and may be an operation amount other than the neutral position.

In the above-mentioned embodiment, even when the operation of the traveling operation member 59 from the neutral position or the operation of the traveling operation member 59 itself is unstable, a threshold can be set according to the situation, thereby improving a control accuracy in performing the automatic speed reduction at a timing when the automatic speed reduction should be performed.

Figure 9:
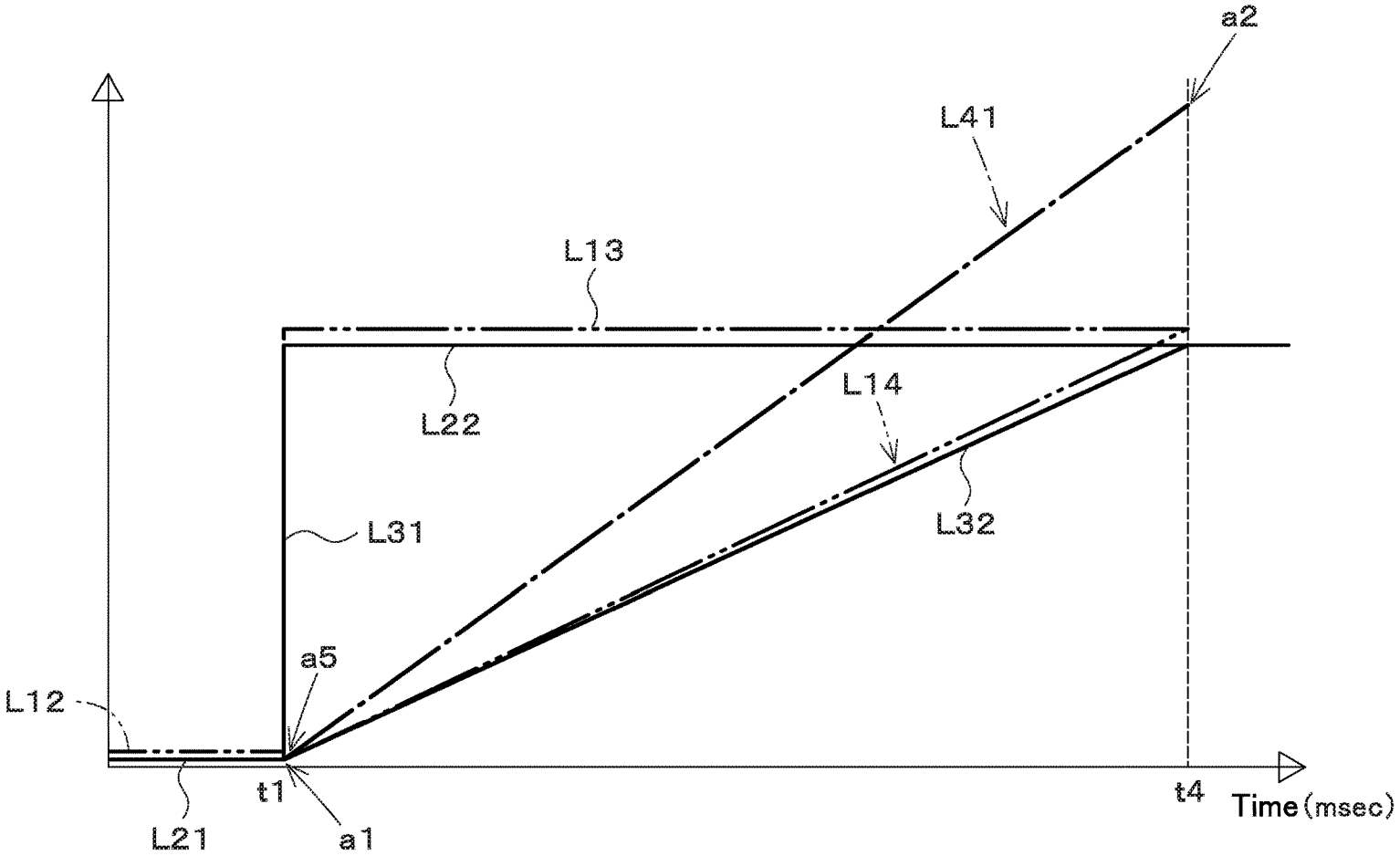
FIG. 9 is a view showing a restraining control for the automatic speed reduction according to another example.

In the embodiment shown in FIG. 7, the rotation speed at the starting point a5 on the fourth threshold line L14 is set to a higher rotation speed than the rotation speed at the starting point a1 on the motor rotation speed line L41; however, the rotation speed is not limited thereto. That is, as shown in FIG. 9, the starting point a5 of the fourth threshold line L14 may be made to coincide with the starting point a1 of the motor rotation speed line L41. According to this configuration, the judgment time T1 shown in FIG. 7 need not be provided. The starting point a5 of the fourth threshold line L14 may be positioned lower than the starting point a1 of the motor rotation speed line L41.

Figure 10:
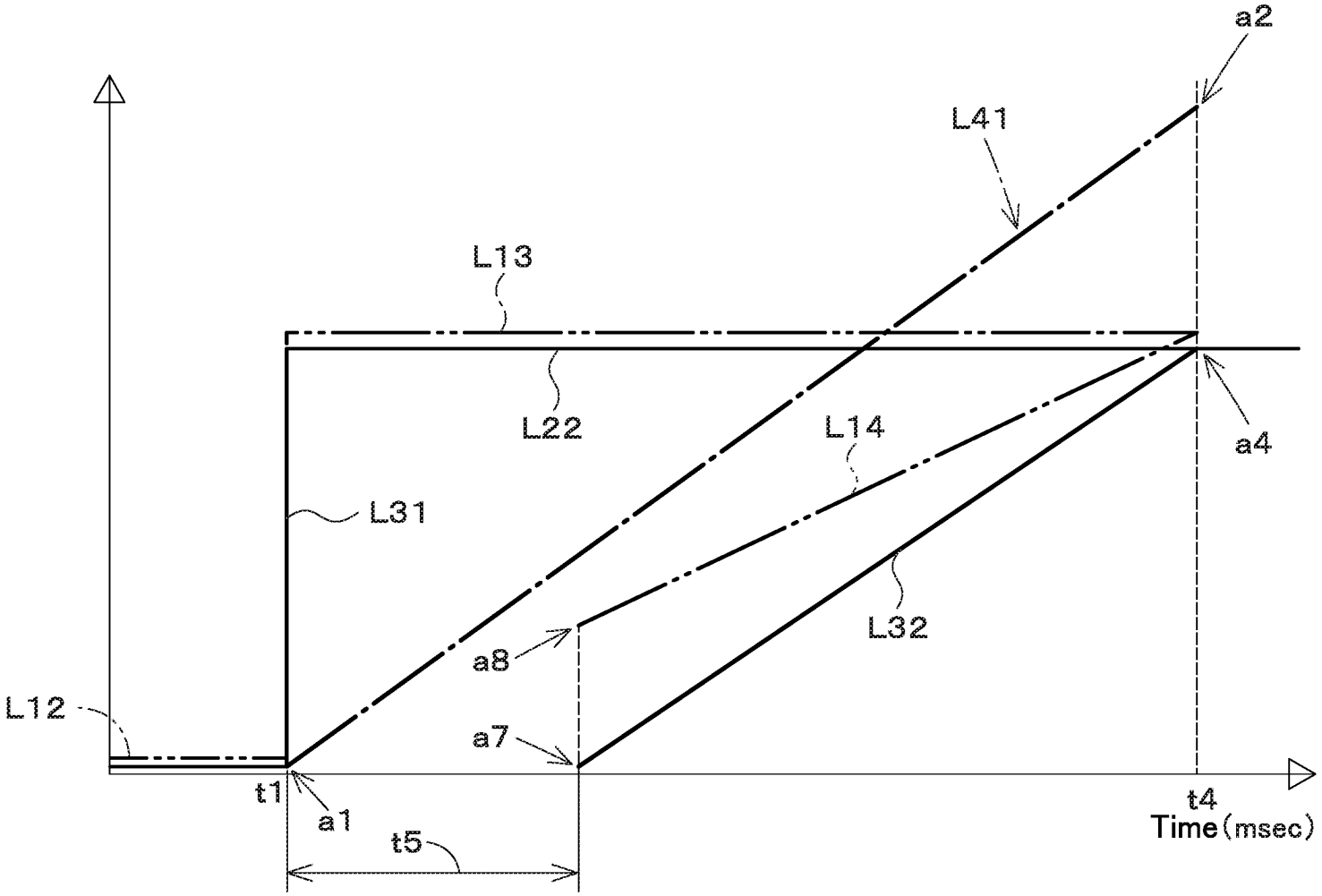
FIG. 10 is a view showing a restraining control for the automatic speed reduction according to another example.

As shown in FIG. 10, a starting point a7 on the second change rate line L32, which represents the virtual change rate of the operation amount, may be delayed by a time t5 from the time t1. That is, in this case, the virtual change rate of the operation amount is calculated after the predetermined time t5 has passed since the traveling operation member 59 is operated to change an operation amount from the first operation amount W11. In other words, the operation amount change calculation section 62A is set to calculate the virtual change rate of the operation amount after the predetermined time t5 has passed since the traveling operation member 59 is operated to change an operation amount from the first operation amount W11.

When the starting point a7 on the second change rate line L32 is delayed by the time t5, a starting point a8 on the fourth threshold line L14 is also delayed by the time t5. This makes it possible to set the fourth threshold line L14 lower than the motor rotation speed line L41. Accordingly, even in this case, the judgment time T1 shown in FIG. 7 need not be provided.

Figure 11:
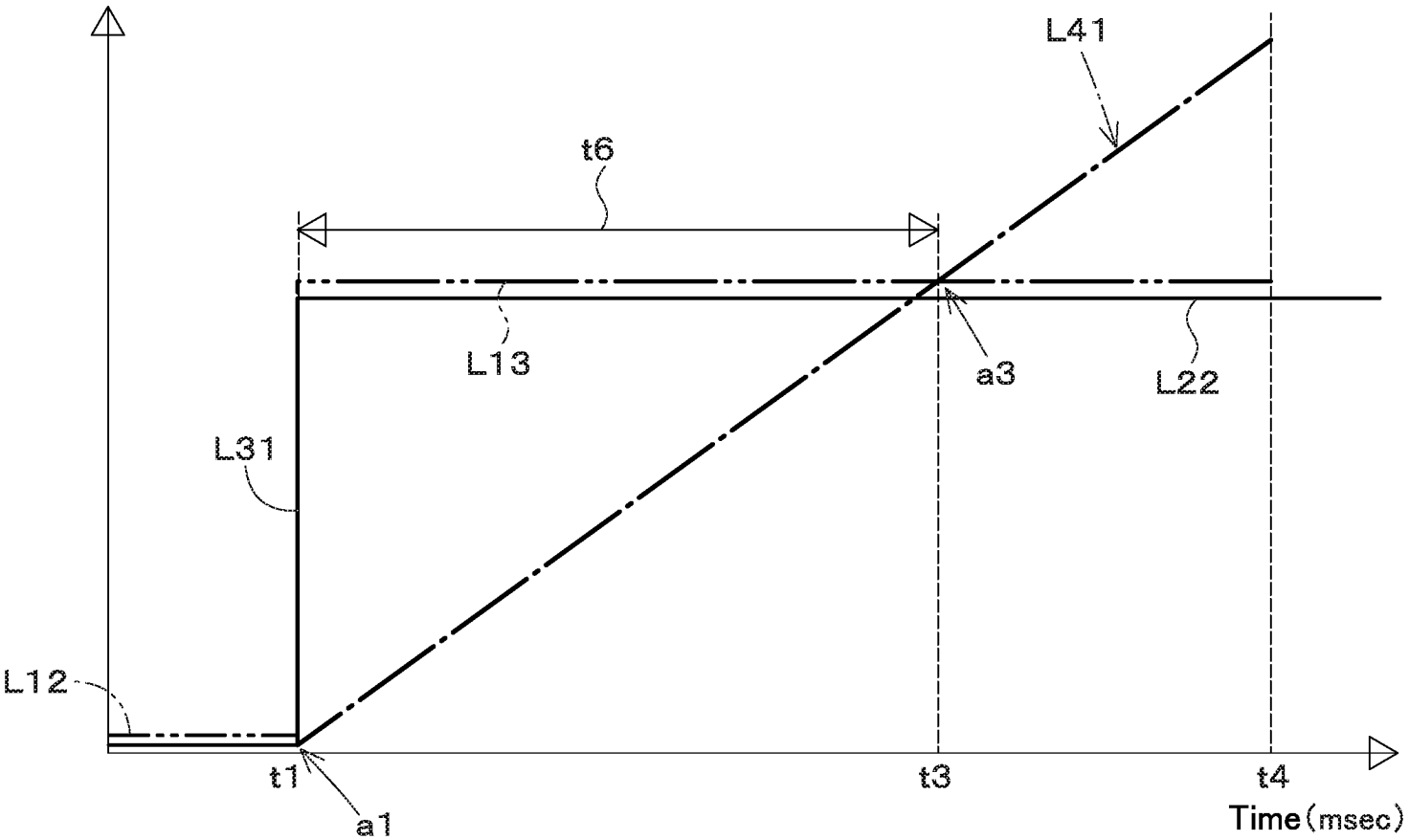
FIG. 11 is a view showing a restraining control for the automatic speed reduction according to another example.

FIG. 11 does not show an embodiment in which the automatic speed reduction restraining unit 62 calculates, as in the embodiments shown in FIGS. 7 to 10, the virtual motor rotation speed threshold corresponding to the virtual change rate of the operation amount and the virtual change rate of the operation amount, but instead shows an embodiment in which that the automatic speed reduction restraining unit 62 prohibits the automatic speed reduction unit 61 from performing the automatic speed reduction until a predetermined time t3 after an operation of the traveling operation member 59. Accordingly, in the case of the embodiment shown in FIG. 11, the automatic speed reduction restraining unit 62 does not include the operation amount change calculation section 62A and the rotation speed threshold calculation section 62B.

That is, in the embodiment shown in FIG. 11, the automatic speed reduction restraining unit 62 prohibits the automatic speed reduction unit 61 from performing the automatic speed reduction until a predetermined time has passed after the traveling operation member 59 is operated to change an operation amount from the first operation amount W11 to the second operation amount W12, in a case where an operation amount of the traveling operation member 59 is changed from the first operation amount W11 to the second operation amount W12. A prohibition time t6 to prohibit the automatic speed reduction is a time until the motor rotation speed rises to the motor rotation speed threshold at which the automatic speed reduction unit 61 judges whether or not to perform the automatic speed reduction in a state where the traveling operation member 59 is operated to change an operation amount to the second operation amount W12, that is, a time from the time t1 to the time t3. In this manner, until the motor rotation speed line L41 intersects the third threshold line L13 at the intersection point a3 after an operation time of the traveling operation member 59 has passed from the time t1 to the time t3, the automatic speed reduction unit 61 does not make a judgment as to whether or not to perform the automatic speed reduction, thereby preventing an accidental automatic speed reduction even when an operation amount of the traveling operation member 59 is changed steeply from the first operation amount W11 to the second operation amount W12.

In the above-described embodiment, the operation device 54 is a hydraulic device that changes a pilot pressure applied to the traveling pumps 53 (left traveling pump 53L and right traveling pump 53R) with the operation valves 55; however, the operation device 54 may be constituted of an electrically-operable joystick. That is, as shown in FIGS. 1B and 1C, the operation device 54 with the traveling operation member 59 may be an electrically-actuated device.

Figure 1B:
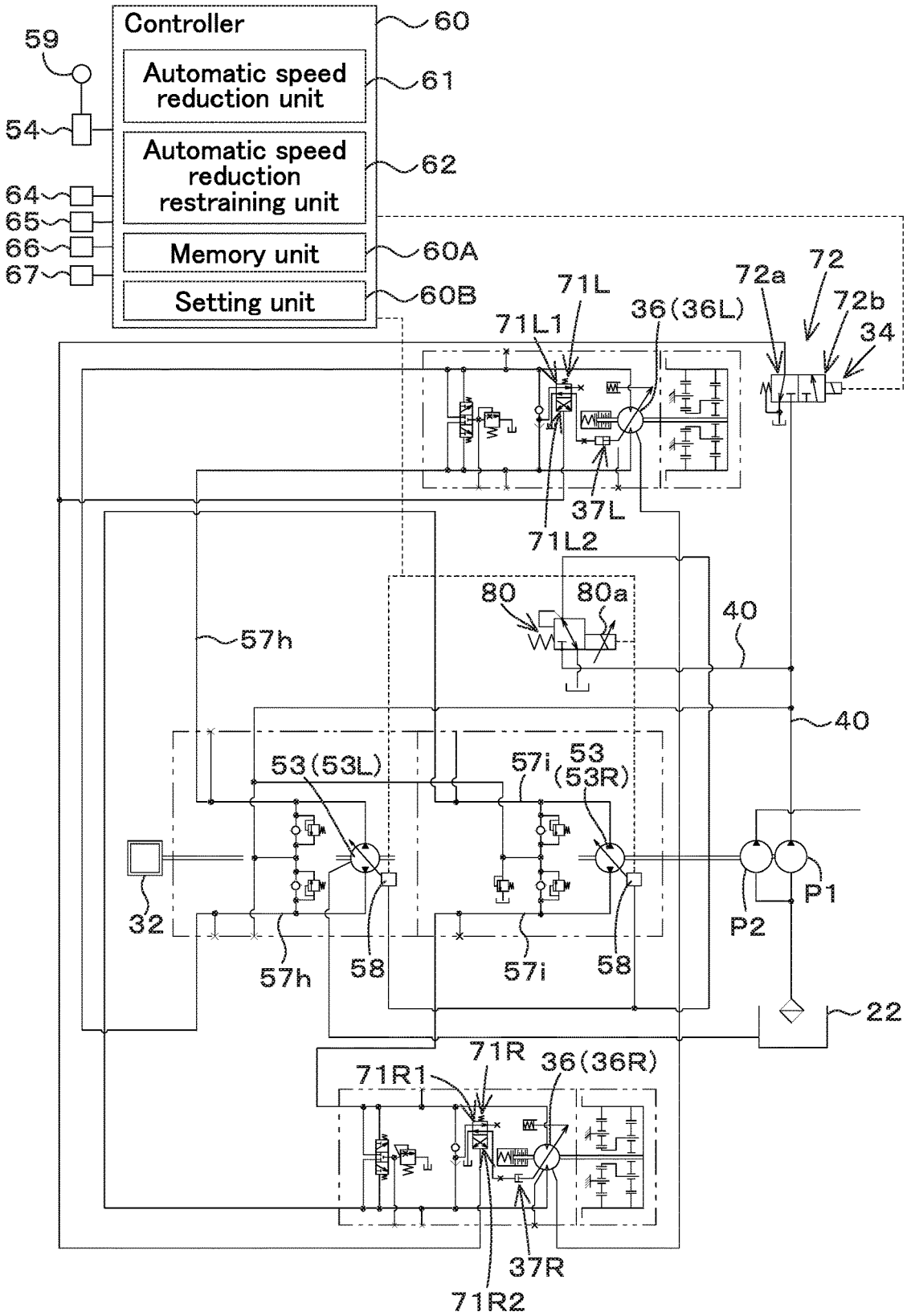
FIG. 1B is a view showing a hydraulic system (hydraulic circuit) for the working machine in which an operation device replaced by an electrically-operable joystick.
Figure 1C:
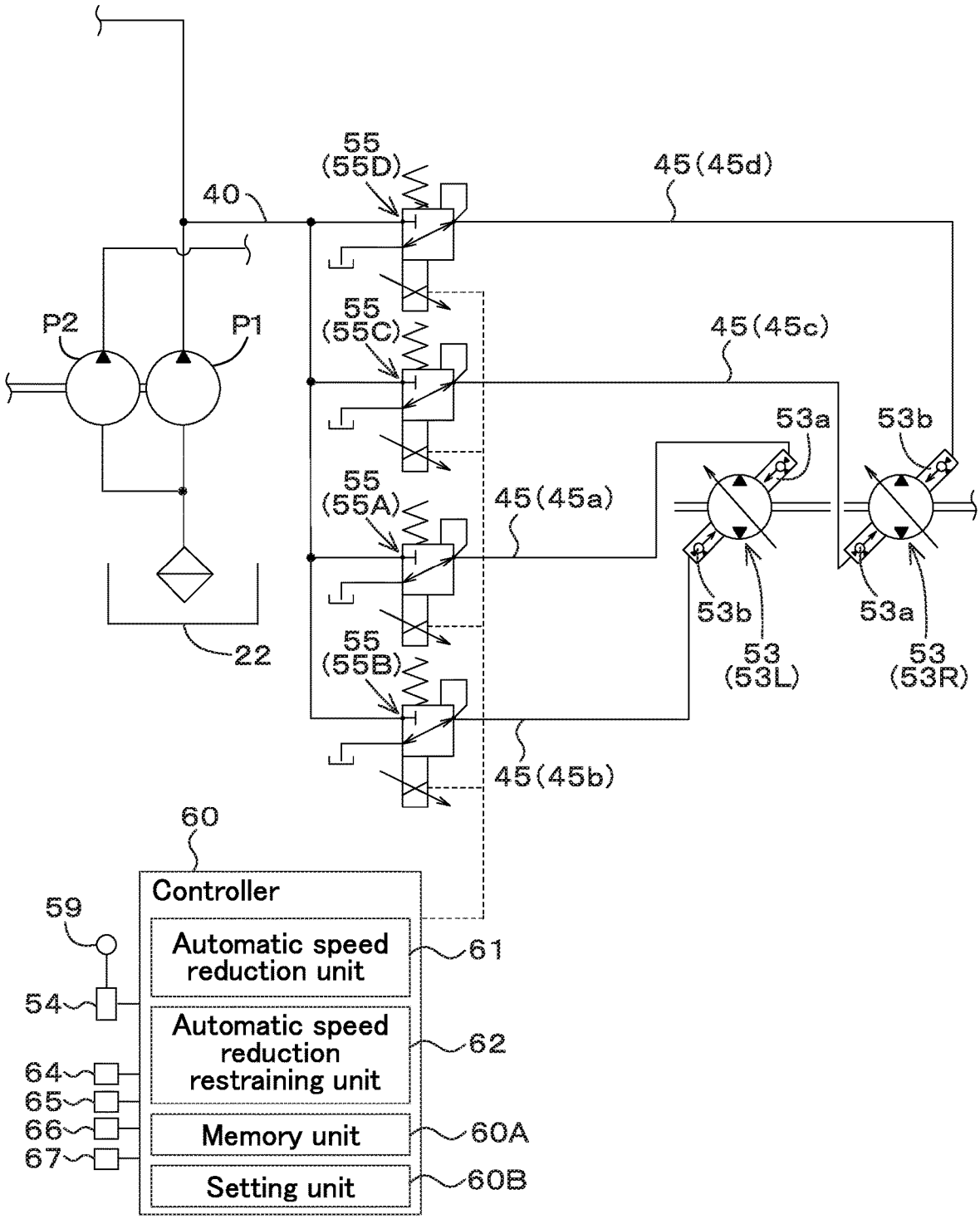
FIG. 1C is a view showing a hydraulic system (hydraulic circuit) for the working machine in which an operation valve and an actuation valve are integrated (as a dual-use valve).

As shown in FIG. 1B, the traveling operation member 59 is an operation lever swingable in the lateral direction (machine width direction) or the fore-and-aft direction, as in the embodiments described above. The operation detector 64, which detects an operation amount and operation direction of the traveling operation member 59, is constituted of a potentiometer or the like configured to detect a swinging amount of the traveling operation member 59.

A hydraulic regulator 58 configured to operate the swash plates of the traveling pumps 36 (left traveling pump 53L and right traveling pump 53R) are connected to the controller 60. When the operation lever 59 is operated forward (see the direction of the arrowed line A1 in FIG. 1A), the controller 60 outputs a control signal to the hydraulic regulator 58, and the hydraulic regulator 58 causes the swash plates of the left traveling pump 53L and the right traveling pump 53R to swing in a direction for normal rotation (forward traveling).

When the operation lever 59 is operated backward (see the direction of the arrowed line A1 in FIG. 1A), the controller 60 outputs a control signal to the hydraulic regulator 58, and the hydraulic regulator 58 causes the swash plates of the left traveling pump 53L and the right traveling pump 53R to swing in a direction for reverse rotation (backward traveling).

When the operation lever 59 is operated rightward (see the direction of the arrowed line A3 in FIG. 1A), the controller 60 outputs a control signal to the hydraulic regulator 58, and the hydraulic regulator 58 causes the swash plate of the left traveling pump 53L to swing in the direction for normal rotation and the swash plate of the right traveling pump 53R to swing in the direction for reverse rotation.

When the operation lever 59 is operated leftward (see the direction of the arrowed line A4 in FIG. 1A), the controller 60 outputs a control signal to the hydraulic regulator 58, and the hydraulic regulator 58 causes the swash plate of the left traveling pump 53L to swing in the direction for reverse rotation and the swash plate of the right traveling pump 53R to swing in the direction for normal rotation.

The hydraulic system for the working machine shown in FIG. 1B includes an actuation valve 80. The actuation valve 80 is a valve configured to change a pilot pressure of the pilot fluid supplied to the hydraulic regulator 58 that operates the traveling pumps 53 (left traveling pump 53L and right traveling pump 53R). The actuation valve 80 is provided on the delivery fluid passage 40 through which the pilot fluid flows, and varies an opening degree thereof to change a pilot pressure of the pilot fluid that actuates the hydraulic regulator 58. For example, the actuation valve 80 is a solenoid proportional valve configured to vary an opening degree thereof based on a control signal (e.g., voltage, current) output from the controller 60.

That is, the controller 60 magnetizes a proportional solenoid 80*a* of the actuation valve 80 to vary a pilot pressure (actuation pilot pressure) output from the actuation valve 80 to the hydraulic regulator 58.

The controller 60 sets the actuation pilot pressure to be varied by the actuation valve 80 to a value when the traveling motors 36 are set at the first speed, and to another different value when the driving motors 36 are at the second speed. The controller 60 sets the actuation pilot pressure based on the prime mover rotation speed, the first speed, and the second speed. For example, the controller 60 sets a first speed pilot pressure, which is the actuation pilot pressure for the traveling motors 36 set at the first speed, based on the prime mover rotation speed when the traveling motors 36 are at the first speed. In addition, the controller 60 sets a second speed pilot pressure, which is the actuation pilot pressure for the traveling motors 36 set at the second speed, based on the prime mover rotation speed when the traveling motors 36 are at the second speed.

The controller 60 sets the second speed pilot pressure determined when the traveling motors 36 are at the second speed to a lower value than the first speed pilot pressure determined when the traveling motor 36 is at the first speed.

As shown in FIG. 1B, the controller 60 includes a memory unit 60A and a setting unit 60B. The memory unit 60A is a non-volatile memory and stores control information to be used for setting the actuation pilot pressures. The control information is data that shows a relationship between the actuation pilot pressures and the prime mover rotation speed. The setting unit 60B is constituted of an electrical/electronic circuit provided in the controller 60, a computer program stored in the controller 60, or the like. The setting unit 60B sets the actuation pilot pressures (first speed pilot pressure and second speed pilot pressure) based on the control information stored in the memory unit 60A.

In FIG. 1B, the hydraulic regulator 58 is connected to the controller 60; instead, as shown in FIG. 1C, the operation valves 55 (operation valves 55A, 55B, 55C, 55D) constituted of proportional solenoid valves may be provided, and the controller 60 may operate the operation valves 55 (operation valves 55A, 55B, 55C, 55D) according to an operation amount and operation direction of the operation lever 59. The operation valves 55 (operation valves 55A, 55B, 55C, 55D) determines the pilot pressures to be applied to the pressure receiving portions 53*a* and 53*b* of the traveling pumps 53 (left traveling pump 53L and right traveling pump 53R) according to the operation direction and operation amount of the operation lever 59. In the hydraulic system of FIG. 1A, opening degrees of the operation valves 55 are directly changed by an operation of the traveling operation member 59; however, in the hydraulic system of FIG. 1C, opening degrees of the operation valves 55 are changed with a control signal corresponding to an operation of the traveling operation member 59 being transmitted from the controller 60 to the operation valves 55.

The operation valves 55 (operation valves 55A, 55B, 55C, and 55D) in FIG. 1C are integrated with the actuation valves.

The above-mentioned working machine 1 includes the vehicle body 2, the traveling devices 5 supporting the vehicle body 2 so as to allow the vehicle body 2 to travel, the traveling motors 36 configured to output power to the traveling devices 5 and be shifted between the first speed and the second speed faster than the first speed, the traveling pumps 53 configured to supply the hydraulic fluid to the traveling motors 36, the rotation speed detectors 68 configured to detect the motor rotation speeds that are rotation speeds of the traveling motors 36, the traveling operation member 59 operable to operate the traveling pumps 53, the operation detector 64 configured to detect an operation amount of the traveling operation member 59, and the controller 60 including the automatic speed reduction unit 61 configured or programmed to perform the automatic speed reduction in which the traveling motors 36 having been shifted to the second speed is automatically shifted from the second speed to the first speed based on the operation amount of the traveling operation member 59. The controller 60 includes the automatic speed reduction restraining unit 62 configured or programmed to restrain the automatic speed reduction from being performed when the traveling operation member 59 is operated to steeply change the operation amount from the first operation amount W11 to the second operation amount W12.

According to this configuration, the automatic speed reduction can be restrained in the case where an operation amount of the traveling operation member 59 is changed steeply from the first operation amount W11 to the second operation amount W12.

In addition, the automatic speed reduction restraining unit 62 includes the operation amount change calculation section 62A configured or programmed to calculate, when the traveling operation member 59 is operated to change the operation amount from the first operation amount W11 to the second operation amount W12, the virtual change rate of the operation amount that defines a time delay from the actual change rate of the operation amount from the first operation amount W11 to the second operation amount W12, the time delay being increased according to increase of the operation amount, and a rotation speed threshold calculation section 62B configured or programmed to calculate the virtual motor rotation speed threshold corresponding to the virtual change rate of the operation amount calculated by the operation amount change calculation section 62A. The automatic speed reduction unit 61 is configured or programmed to perform the automatic speed reduction when the traveling motors are in the second speed and the motor rotation speeds detected by the rotation speed detectors 68 become less than the virtual motor rotation speed threshold.

Also, according to this configuration, the automatic speed reduction can be restrained in the case where an operation amount of the traveling operation member 59 is changed steeply from the first operation amount W11 to the second operation amount W12.

In addition, the automatic speed reduction unit 61 is configured or programmed to judge whether the motor rotation speeds are less than the virtual motor rotation speed threshold or not after the traveling operation member 59 has been operated to change the operation amount from the first operation amount W11 for a predetermined period.

In addition, the operation amount change calculation section 62A is configured or programmed to calculate the virtual change rate of the operation amount after the traveling operation member 59 has been operated to change the operation amount from the first operation amount W11 for a predetermined period.

In addition, the automatic speed reduction restraining unit 62 is configured or programmed to keep, when the traveling operation member 59 is operated to change the operation amount from the first operation amount W11 to the second operation member W12, the automatic speed reduction unit 61 from performing the automatic speed reduction until the traveling operation member 59 has been operated to change the operation amount from the first operation amount W11 for a predetermined period.

Also, according to this configuration, the automatic speed reduction can be restrained in the case where an operation amount of the traveling operation member 59 is changed steeply from the first operation amount W11 to the second operation amount W12.

In addition, the automatic speed reduction is kept from being performed for a period of time that is taken to increase the motor rotation speeds while the traveling operation member 59 is operated to have the second operation amount W12 until the motor rotation speeds reach the motor rotation speed threshold for the judgment by the automatic speed reduction unit 61 regarding whether to perform the automatic speed reduction.

According to this configuration, it is possible to restrain the automatic speed reduction from being performed accidentally.

In addition, the time since the traveling operation member 59 is operated to change the operation amount from the first operation amount W11 until the automatic speed reduction unit 61 judges whether the motor rotation speeds are less than the virtual motor rotation speed threshold or not is able to be changed according to variation in the motor rotation speeds and the second operation amount W12.

In addition, the working machine 1 mentioned above, includes the prime mover 32 to drive the traveling pumps 53. The time since the traveling operation member 59 is operated to change the operation amount from the first operation amount W11 until the automatic speed reduction unit 61 judges whether the motor rotation speeds are less than the virtual motor rotation speed threshold or not is able to be changed according to a rotation speed of the prime mover 32.

In addition, the controller 60 is configured or programmed to determine that the traveling operation member 59 is in neutral when the operation amount of the traveling operation member 59 is less than a neutral judgment amount defined as the operation amount changed from the first operation amount W11 by a predetermined amount, and to keep the automatic speed reduction from being performed when the traveling operation member 59 is in neutral.

According to this configuration, it is possible to prevent the automatic speed reduction from being performed near the neutral position.

In addition, the working machine 1 mentioned above, includes the prime mover 32 to drive the traveling pumps 53. The motor rotation speed threshold is able to be changed according to a rotation speed of the prime mover 32.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine comprising:

a vehicle body;

a traveling device supporting the vehicle body so as to allow the vehicle body to travel;

a traveling motor configured to output power to the traveling device and be shifted between a first speed and a second speed faster than the first speed;

a traveling pump configured to supply hydraulic fluid to the traveling motor;

a rotation speed detector, including at least a sensor, configured to detect a motor rotation speed that is a rotation speed of the traveling motor;

a traveling operation member, including at least a lever operable to operate the traveling pump;

an operation detector, including at least an other sensor, configured to detect an operation amount of the traveling operation member; and a controller, including at least a processor, configured to;

perform automatic speed reduction in which the traveling motor having been shifted to the second speed is automatically shifted from the second speed to the first speed based on the operation amount of the traveling operation member, and restrain the automatic speed reduction from being performed when the traveling operation member is operated to change the operation amount from a first operation amount to a second operation amount at an actual change rate greater than a predetermined threshold.

2. The working machine according to claim 1, wherein the controller is further configured to:

calculate, when the traveling operation member is operated to change the operation amount from the first operation amount to the second operation amount, a virtual change rate of the operation amount that defines a time delay from the actual change rate of the operation amount from the first operation amount to the second operation amount, the time delay being increased according to increase of the operation amount, and calculate a virtual motor rotation speed threshold corresponding to the virtual change rate of the operation amount, and perform the automatic speed reduction when the traveling motor is in the second speed and the motor rotation speed detected by the rotation speed detector becomes less than the virtual motor rotation speed threshold.

3. The working machine according to claim 2, wherein the controller is further configured to judge whether the motor rotation speed is less than the virtual motor rotation speed threshold or not after the traveling operation member has been operated to change the operation amount from the first operation amount for a predetermined period.

4. The working machine according to claim 2, wherein the controller is further configured to calculate the virtual change rate of the operation amount after the traveling operation member has been operated to change the operation amount from the first operation amount for a predetermined period.

5. The working machine according to claim 1, wherein the controller is further configured to keep, when the traveling operation member is operated to change the operation amount from the first operation amount to the second operation amount, from performing the automatic speed reduction until the traveling operation member has been operated to change the operation amount from the first operation amount for a predetermined period.

6. The working machine according to claim 5, wherein the automatic speed reduction is kept from being performed for a period of time that is taken to increase the motor rotation speed while the traveling operation member is operated to have the second operation amount until the motor rotation speed reaches the motor rotation speed threshold for the judgment by the controller regarding whether to perform the automatic speed reduction.

7. The working machine according to claim 3, wherein the time since the traveling operation member is operated to change the operation amount from the first operation amount until the controller judges whether the motor rotation speed is less than the virtual motor rotation speed threshold or not is able to be changed according to variation in the motor rotation speed and the second operation amount.

8. The working machine according to claim 3, further comprising:

a prime mover to drive the traveling pump, wherein the time since the traveling operation member is operated to change the operation amount from the first operation amount until the controller judges whether the motor rotation speed is less than the virtual motor rotation speed threshold or not is able to be changed according to a rotation speed of the prime mover.

9. The working machine according to claim 1, wherein the controller is further configured to:

determine that the traveling operation member is in neutral when the operation amount of the traveling operation member is less than a neutral judgment amount defined as the operation amount changed from the first operation amount by a predetermined amount, and keep the automatic speed reduction from being performed when the traveling operation member is in neutral.

10. The working machine according to claim 9, further comprising:

a prime mover to drive the traveling pump, wherein the motor rotation speed threshold is able to be changed according to a rotation speed of the prime mover.

* * * * *